US007175260B2

(12) United States Patent
Silverbrook

(10) Patent No.: US 7,175,260 B2
(45) **Date of Patent: *Feb. 13, 2007**

(54) INK JET NOZZLE ARRANGEMENT CONFIGURATION

(75) Inventor: Kia Silverbrook, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 105 days.

This patent is subject to a terminal disclaimer.

(21) Appl. No.: 10/510,093

(22) PCT Filed: Aug. 29, 2002

(86) PCT No.: PCT/AU02/01162

§ 371 (c)(1),
(2), (4) Date: Oct. 5, 2004

(87) PCT Pub. No.: WO2004/002743

PCT Pub. Date: Jan. 8, 2004

(65) Prior Publication Data

US 2005/0174389 A1 Aug. 11, 2005

Related U.S. Application Data

(63) Continuation of application No. 10/183,182, filed on Jun. 28, 2002.

(51) Int. Cl.

| | |
|---|---|
| ***B41J 2/05*** | (2006.01) |
| ***B41J 2/15*** | (2006.01) |
| ***B41J 2/145*** | (2006.01) |
| ***B41J 2/04*** | (2006.01) |

(52) U.S. Cl. ..... 347/59; 347/40; 347/54; 347/56

(58) Field of Classification Search ..... 347/42, 347/49, 54, 56–59

See application file for complete search history.

(56) References Cited

U.S. PATENT DOCUMENTS 4,423,401 A 12/1983 Mueller (Continued)

FOREIGN PATENT DOCUMENTS

DE 1648322 A 3/1971

(Continued)

OTHER PUBLICATIONS

Ataka, Manabu et al, "Fabrication and Operation of Polymide Bimorph Actuators for Ciliary Motion System". Journal of Microelectromechanical Systems, US, IEEE Inc. New York, vol. 2, No. 4, Dec. 1, 1993, pp. 146-150, XP000443412, ISSN: 1057-7157.

(Continued)

*Primary Examiner*—Lamson Nguyen
*Assistant Examiner*—Lisa M. Solomon

(57) ABSTRACT

An inkjet printhead chip includes a wafer substrate (116). Drive circuitry is positioned on the wafer substrate. A plurality of nozzle arrangements is positioned on the wafer substrate. Each nozzle arrangement includes nozzle chamber walls (132) and a roof wall positioned on the wafer substrate to define a nozzle chamber (134) and an ink ejection port (124) in the roof wall. A micro-electromechanical actuator (128) is connected to the drive circuitry. The actuator includes a movable member (130) that is displaceable on receipt of a signal from the drive circuitry. The movable member defines a displacement surface that acts on ink in the nozzle chamber to eject the ink from the ink ejection port. An area of the displacement surface is between half and twice a cross sectional area of the ink ejection port.

5 Claims, 37 Drawing Sheets

U.S. PATENT DOCUMENTS

| | | | | |
|---|---|---|---|---|
| 4,553,393 | A | 11/1985 | Ruoff | |
| 4,672,398 | A | 6/1987 | Kuwabara et al. | |
| 4,737,802 | A | 4/1988 | Mielke | |
| 4,864,824 | A | 9/1989 | Gabriel et al. | |
| 5,029,805 | A | 7/1991 | Albarda et al. | |
| 5,258,774 | A | 11/1993 | Rogers | |
| 5,666,141 | A | 9/1997 | Matoba et al. | |
| 5,719,604 | A | 2/1998 | Inui et al. | |
| 5,812,159 | A | 9/1998 | Anagnostopoulos et al. | |
| 6,245,247 | B1 | 6/2001 | Silverbrook | |
| 6,258,284 | B1 | 7/2001 | Silverbrook | |
| 6,378,989 | B1 | 4/2002 | Silverbrook | |
| 2002/0186279 | A1* | 12/2002 | Silverbrook | 347/54 |

FOREIGN PATENT DOCUMENTS

| | | | |
|---|---|---|---|
| DE | 2905063 | | 8/1980 |
| DE | 3245283 | A | 6/1984 |
| DE | 3430155 | A | 2/1986 |
| DE | 3716996 | A | 12/1988 |
| DE | 3934280 | A | 4/1990 |
| DE | 4328433 | A | 3/1995 |
| DE | 19516997 | A | 11/1995 |
| DE | 19517969 | A | 11/1995 |
| DE | 19532913 | A | 3/1996 |
| DE | 19623620 | A1 | 12/1996 |
| DE | 19639717 | A | 4/1997 |
| EP | 0092229 | A | 10/1983 |
| EP | 0398031 | A | 11/1990 |
| EP | 0427291 | A | 5/1991 |
| EP | 0431338 | A | 6/1991 |
| EP | 0478956 | A | 4/1992 |
| EP | 0506232 | A | 9/1992 |
| EP | 0510648 | A | 10/1992 |
| EP | 0627314 | A | 12/1994 |
| EP | 0634273 | A2 | 1/1995 |
| EP | 0713774 | A2 | 5/1996 |
| EP | 0737500 | A | 10/1996 |
| EP | 0750993 | A | 1/1997 |
| EP | 0882590 | A | 12/1998 |
| FR | 2231076 | A | 12/1974 |
| GB | 792145 | A | 3/1958 |
| GB | 1428239 | A | 3/1976 |
| GB | 2262152 | A | 6/1993 |
| JP | 58-112747 | A | 7/1983 |
| JP | 58-116165 | A | 7/1983 |
| JP | 61-025849 | A | 2/1986 |
| JP | 61-268453 | A | 11/1986 |
| JP | 01-105746 | A | 4/1989 |
| JP | 01-115639 | A | 5/1989 |
| JP | 01-128839 | A | 5/1989 |
| JP | 01-257058 | A | 10/1989 |
| JP | 01-306254 | A | 12/1989 |
| JP | 02-050841 | A | 2/1990 |
| JP | 02-092643 | A | 4/1990 |
| JP | 02-158348 | A | 6/1990 |
| JP | 02-162049 | A | 6/1990 |
| JP | 02-108544 | A | 10/1990 |
| JP | 02-265752 | A | 10/1990 |
| JP | 03-065348 | A | 3/1991 |
| JP | 03-112662 | A | 5/1991 |
| JP | 03-180350 | A | 8/1991 |
| JP | 04-001051 | A | 1/1992 |
| JP | 04-118241 | A | 4/1992 |
| JP | 04-126255 | A | 4/1992 |
| JP | 04-141429 | A | 5/1992 |
| JP | 04-353458 | A | 12/1992 |
| JP | 04-368851 | A | 12/1992 |
| JP | 05-284765 | A | 10/1993 |
| JP | 05-318724 | A | 12/1993 |
| JP | 06-091865 | A | 4/1994 |
| JP | 07-314665 | A | 12/1995 |
| JP | 2000-141656 | A | 5/2000 |
| JP | 06-091866 | A | 4/2006 |
| WO | WO 94/18010 | A | 8/1994 |
| WO | WO 97/12689 | A | 4/1997 |
| WO | WO 2001/02181 | A | 1/2001 |
| WO | WO 2001/78986 | A | 10/2001 |

OTHER PUBLICATIONS

Nomorolski J M et al: "Process for in-plane and out-of-plane single-crystal-silicon thermal microactuators" Sensors and Actuators A, Ch. Elsevier Sequoia S.A., Lausanne, vol. 55, No. 1, Jul. 15, 1996, pp. 65-69, XP004077979.

Yamagata, Yutaka et al, "A Micro Mobile Mechanism Using Thermal Expansion and its Theoretical Analysis". Proceedings of the workshop on micro electro mechanical systems (MEMS), US, New York, IEEE, vol. Workshop 7, Jan. 25, 1994, pp. 142-147, XP000528408, ISSN: 0-7803-1834-X.

* cited by examiner

INK JET NOZZLE ARRANGEMENT CONFIGURATION

CROSS-REFERENCE TO RELATED APPLICATIONS

This Application is a national phase application (371) of PCT/AU02/01162, filed on Aug. 29, 2002, which is a Continuation Application of U.S. Ser. No. 10/183,182, filed on Jun. 28, 2002, now Issued U.S. Pat. No. 6,682,174.

FIELD OF THE INVENTION

This invention relates to an inkjet printhead chip. In particular, this invention relates to a configuration of an ink jet nozzle arrangement for an ink jet printhead chip.

BACKGROUND OF THE INVENTION

Many different types of printing have been invented, a large number of which are presently in use. The known forms of printers have a variety of methods for marking the print media with a relevant marking media. Commonly used forms of printing include offset printing, laser printing and copying devices, dot matrix type impact printers, thermal paper printers, film recorders, thermal wax printers, dye sublimation printers and ink jet printers both of the drop on demand and continuous flow type. Each type of printer has its own advantages and problems when considering cost, speed, quality, reliability, simplicity of construction and operation etc.

In recent years, the field of ink jet printing, wherein each individual pixel of ink is derived from one or more ink nozzles has become increasingly popular primarily due to its inexpensive and versatile nature.

Many different techniques of ink jet printing have been invented. For a survey of the field, reference is made to an article by J Moore, "Non-Impact Printing: Introduction and Historical Perspective", Output Hard Copy Devices, Editors R Dubeck and S Sherr, pages 207–220 (1988).

Ink Jet printers themselves come in many different types. The utilization of a continuous stream of ink in ink jet printing appears to date back to at least 1929 wherein U.S. Pat. No. 1,941,001 by Hansell discloses a simple form of continuous stream electro-static ink jet printing.

U.S. Pat. No. 3,596,275 by Sweet also discloses a process of a continuous ink jet printing including the step wherein a high frequency electrostatic field modulates the ink jet stream to cause drop separation. This technique is still utilized by several manufacturers including Elmjet and Scitex (see also U.S. Pat. No. 3,373,437 by Sweet et al)

Piezoelectric ink jet printers are also one form of commonly utilized ink jet printing device. Piezoelectric systems are disclosed by Kyser et. al. in U.S. Pat. No. 3,946,398 (1970) which utilizes a diaphragm mode of operation, by Zolten in U.S. Pat. No. 3,683,212 (1970) which discloses a squeeze mode of operation of a piezoelectric crystal, Stemme in U.S. Pat. No. 3,747,120 (1972) discloses a bend mode of piezoelectric operation, Howkins in U.S. Pat. No. 4,459,601 discloses a piezoelectric push mode actuation of the ink jet stream and Fischbeck in U.S. Pat. No. 4,584,590 which discloses a shear mode type of piezoelectric transducer element.

Recently, thermal ink jet printing has become an extremely popular form of ink jet printing. The ink jet printing techniques include those disclosed by Endo et al in GB 2007162 (1979) and Vaught et al in U.S. Pat. No. 4,490,728. Both the aforementioned references disclosed ink jet printing techniques which rely upon the activation of an electrothermal actuator which results in the creation of a bubble in a constricted space, such as a nozzle, which thereby causes the ejection of ink from an aperture connected to the confined space onto a relevant print media. Manufacturers such as Canon and Hewlett Packard manufacture printing devices utilizing the electro-thermal actuator.

As can be seen from the foregoing, many different types of printing technologies are available. Ideally, a printing technology should have a number of desirable attributes. These include inexpensive construction and operation, high-speed operation, safe and continuous long-term operation etc. Each technology may have its own advantages and disadvantages in the areas of cost, speed, quality, reliability, power usage, simplicity of construction, operation, durability and consumables.

In application U.S. Ser. No. 09/112,767 there is disclosed a printhead chip and a method of fabricating the printhead chip. The nozzle arrangements of the printhead chip each include a micro-electromechanical actuator that displaces a movable member that acts on ink within a nozzle chamber to eject ink from an ink ejection port in fluid communication with the nozzle chamber.

In the following patents and patent applications, the Applicant has developed a large number of differently configured nozzle arrangements:

| | | | | |
|---|---|---|---|---|
| 6,227,652 | 6,213,588 | 6,213,589 | 6,231,163 | 6,247,795 |
| 09/113,099 | 6,244,691 | 6,257,704 | 09/112,778 | 6,220,694 |
| 6,257,705 | 6,247,794 | 6,234,610 | 6,247,793 | 6,264,306 |
| 6,241,342 | 6,247,792 | 6,264,307 | 6,254,220 | 6,234,611 |
| 09/112,808 | 6,283,582 | 6,239,821 | 09/113,083 | 6,247,796 |
| 09/113,122 | 09/112,793 | 09/112,794 | 09/113,128 | 09/113,127 |
| 6,227,653 | 6,234,609 | 6,238,040 | 6,188,415 | 6,227,654 |
| 6,209,989 | 6,247,791 | 09/112,764 | 6,217,153 | 09/112,767 |
| 6,243,113 | 6,283,581 | 6,247,790 | 6,260,953 | 6,267,469 |
| 09/425,419 | 09/425,418 | 09/425,194 | 09/425,193 | 09/422,892 |
| 09/422,806 | 09/425,420 | 09/422,893 | 09/693,703 | 09/693,706 |
| 09/693,313 | 09/693,279 | 09/693,727 | 09/693,708 | 09/575,141 |

The above patents/patent applications are incorporated by reference.

The nozzle arrangements of the above patents/patent applications are manufactured using integrated circuit fabrication techniques. Those skilled in the art will appreciate that such techniques require the setting up of a fabrication plant. This includes the step of developing wafer sets. It is extremely costly to do this. It follows that the Applicant has spend many thousands of man-hours developing simulations for each of the configurations in the above patents and patent applications.

The simulations are also necessary since each nozzle arrangement is microscopic in size. Physical testing for millions of cycles of operation is thus generally not feasible for such a wide variety of configurations.

As a result of these simulations, the Applicant has established that a number of common features to most of the configurations provide the best performance of the nozzle arrangements. Thus, the Applicant has conceived this invention to identify those common features.

SUMMARY OF THE INVENTION

According to the invention there is provided an ink jet printhead chip that comprises a wafer substrate, drive circuitry positioned on the wafer substrate, and a plurality of nozzle arrangements positioned on the wafer substrate, each nozzle arrangement comprising nozzle chamber walls and a roof wall positioned on the wafer substrate to define a nozzle chamber and an ink ejection port in the roof wall, a micro-electromechanical actuator that is connected to the drive circuitry, the actuator including a movable member that is displaceable on receipt of a signal from the drive circuitry, the movable member defining a displacement surface that acts on ink in the nozzle chamber to eject the ink from the ink ejection port, wherein the area of the displacement surface is between two and ten times the area of the ink ejection port.

The movable member of each actuator may define at least part of the nozzle chamber walls and roof wall so that movement of the movable member serves to reduce a volume of the nozzle chamber to eject the ink from the ink ejection port. In particular, the movable member of each actuator may define the roof wall.

Each actuator may be thermal in the sense that it may include a heating circuit that is connected to the drive circuitry. The actuator may be configured so that, upon heating, the actuator deflects with respect to the wafer substrate as a result of differential expansion, the deflection causing the necessary movement of the movable member to eject ink from the ink ejection port.

The invention extends to an ink jet printhead that includes a plurality of inkjet printhead chips as described above.

BRIEF DESCRIPTION OF THE DRAWINGS

Notwithstanding any other forms that may fall within the scope of the present invention, preferred forms of the invention will now be described, by way of example only, with reference to the accompanying drawings in which.

DESCRIPTION OF PREFERRED AND OTHER EMBODIMENTS

The preferred embodiments of the present invention disclose an ink jet printhead chip made up of a series of nozzle arrangements. In one embodiment, each nozzle arrangement includes a thermal surface actuator device which includes an L-shaped cross sectional profile and an air breathing edge such that actuation of the paddle actuator results in a drop being ejected from a nozzle utilizing a very low energy level.

Figure 1:
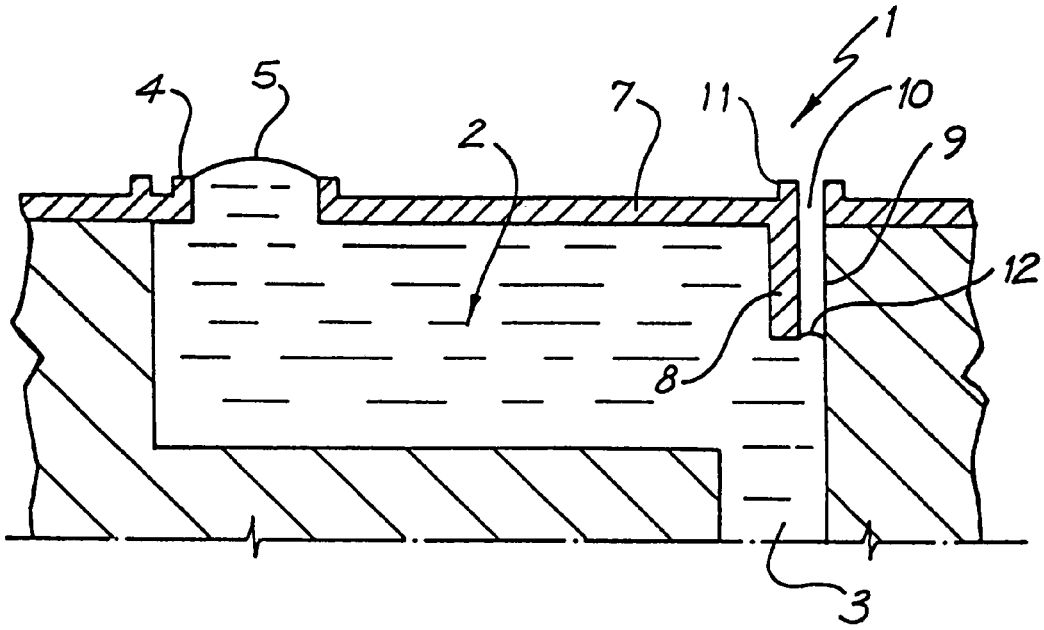
FIG. 1 to FIG. 3 are schematic sectional views illustrating the operational principles of a nozzle arrangement of an ink jet printhead chip of the invention.
Figure 2:
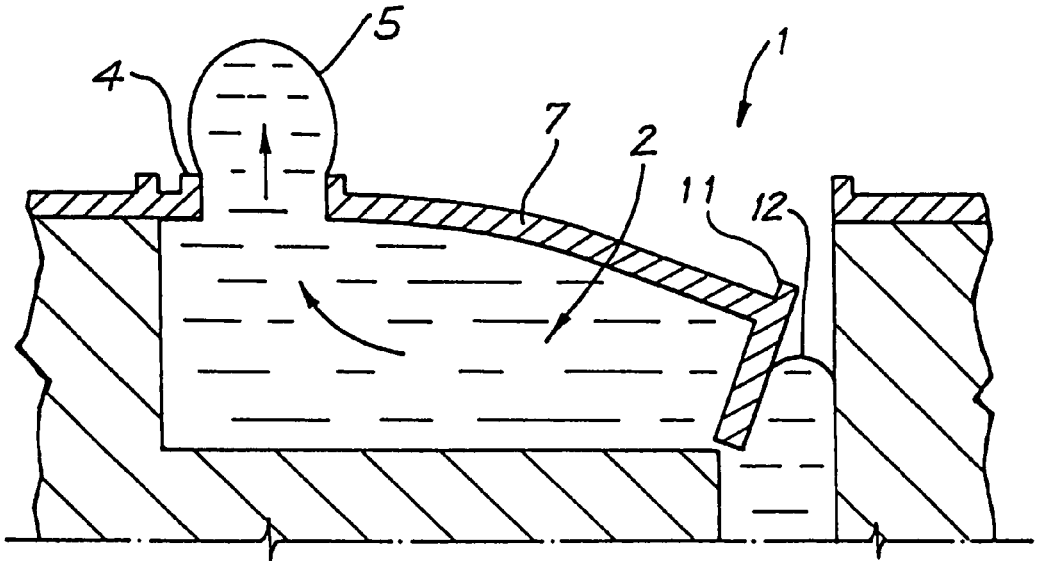
Figure 3:
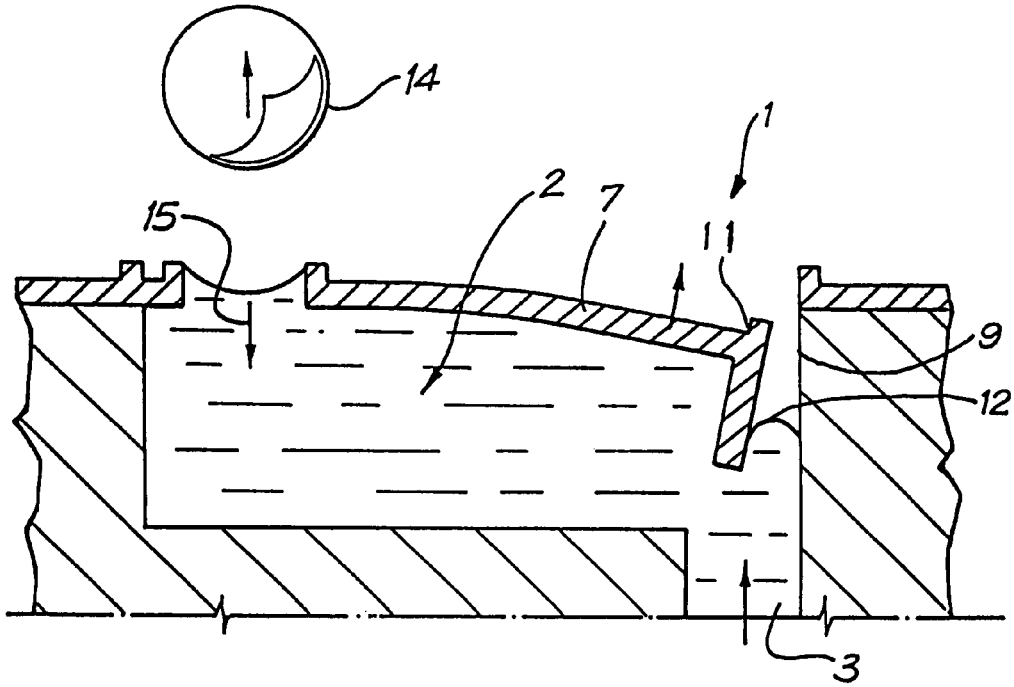

Turning initially to FIG. 1 to FIG. 3, there will now be described the operational principles of the preferred embodiment. In FIG. 1, there is illustrated schematically a sectional view of a single nozzle arrangement 1 which includes an ink nozzle chamber 2 containing an ink supply which is resupplied by means of an ink supply channel 3. A nozzle rim 4 is provided to define an ink ejection port. A meniscus 5 forms across the ink ejection port, with a slight bulge when in the quiescent state. A bend actuator device 7 is formed on the top surface of the nozzle chamber and includes a side arm 8 which runs generally parallel to the nozzle chamber wall 9 so as to form an "air breathing slot" 10 which assists in the low energy actuation of the bend actuator 7. Ideally, the front surface of the bend actuator 7 is hydrophobic such that a meniscus 12 forms between the bend actuator 7 and the nozzle chamber wall 9 leaving an air pocket in slot 10.

When it is desired to eject a drop via the nozzle rim 4, the bend actuator 7 is actuated so as to rapidly bend down as illustrated in FIG. 2. The rapid downward movement of the actuator 7 results in a general increase in pressure of the ink within the nozzle chamber 2. This results in an outflow of ink around the nozzle rim 4 and a general bulging of the meniscus 5. The meniscus 12 undergoes a low amount of movement.

The actuator device 7 is then turned off to return slowly to its original position as illustrated in FIG. 3. The return of the actuator 7 to its original position results in a reduction in the pressure within the nozzle chamber 2 which results in a general back flow of ink into the nozzle chamber 2. The forward momentum of the ink outside the nozzle chamber in addition to the back flow of ink 15 results in a general necking and breaking off of the drop 14. Surface tension effects then draw further ink into the nozzle chamber via ink supply channel 3. Ink is drawn into the nozzle chamber 3 until the quiescent position of FIG. 1 is again achieved.

Figure 4A:
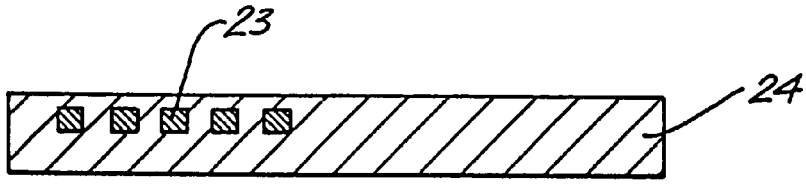
FIG. 4*a* and FIG. 4*b* illustrate the operational principles of a thermal actuator of the nozzle arrangement.
Figure 4B:
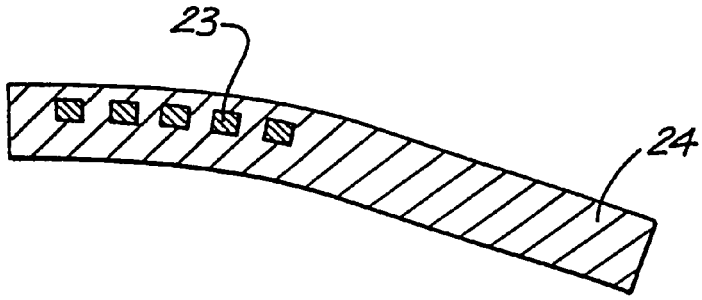

The actuator device 7 can be a thermal actuator that is heated by means of passing a current through a conductive core. Preferably, the thermal actuator is provided with a conductive core encased in a material such as polytetrafluoroethylene that has a high coefficient of thermal expansion. As illustrated in FIG. 4, a conductive core 23 is preferably of a serpentine form and encased within a material 24 having a high coefficient of thermal expansion. Hence, as illustrated in FIG. 4*b*, on heating of the conductive core 23, the material 24 expands to a greater extent and is therefore caused to bend down in accordance with requirements.

Figure 5:
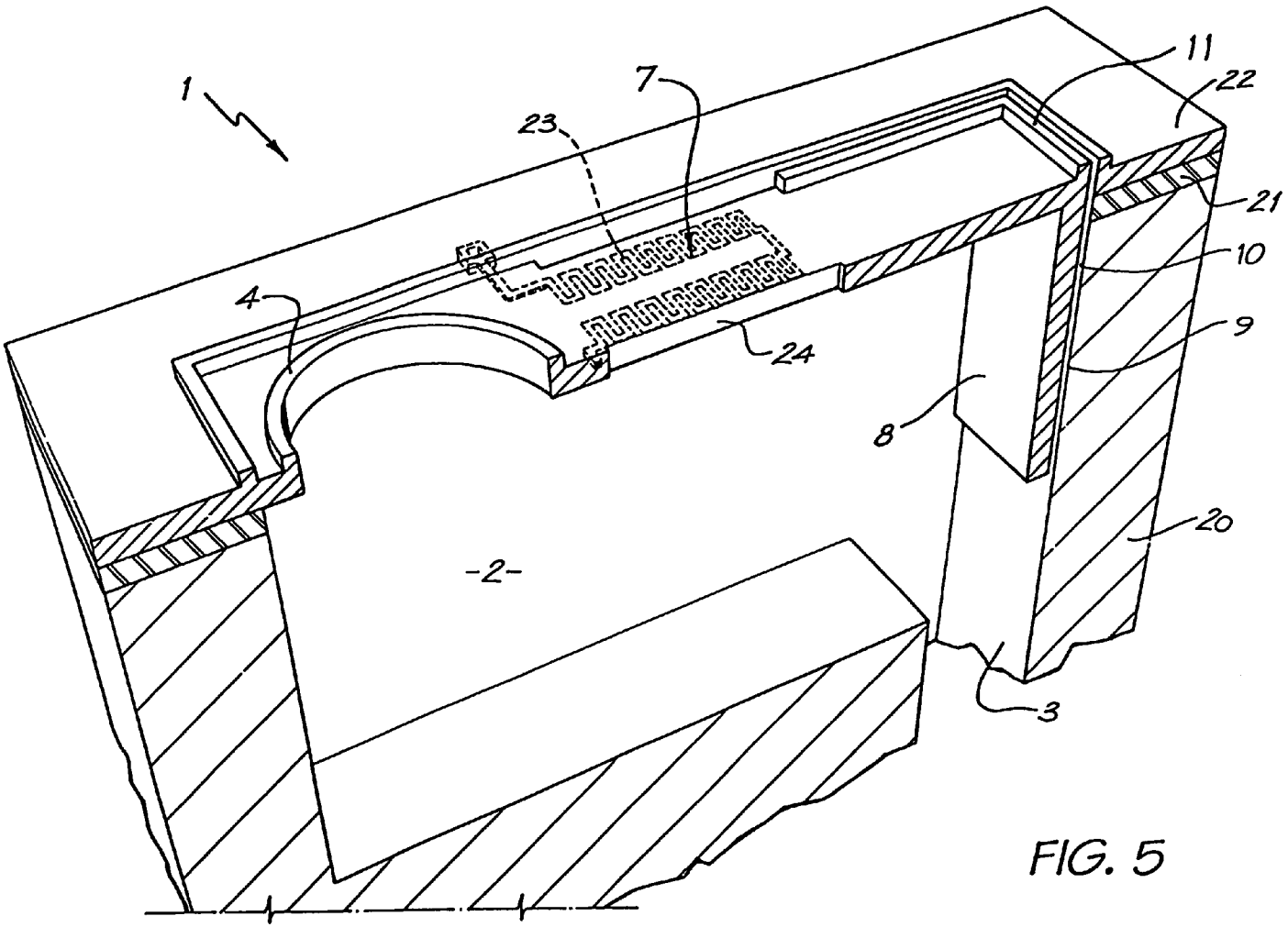
FIG. 5 is a side perspective view of a single nozzle arrangement of the preferred embodiment.

In FIG. 5, there is illustrated a side perspective view, partly in section, of a single nozzle arrangement when in the state as described with reference to FIG. 2. The nozzle arrangement 1 can be formed in practice on a semiconductor wafer 20 utilizing standard MEMS techniques.

The silicon wafer 20 preferably is processed so as to include a CMOS layer 21 which can include the relevant electrical circuitry required for full control of a series of nozzle arrangements 1 that define the printhead chip of the invention. On top of the CMOS layer 21 is formed a glass layer 22 and an actuator 7 which is driven by means of passing a current through a serpentine copper coil 23 which is encased in the upper portions of a polytetrafluoroethylene (PTFE) layer 24. Upon passing a current through the coil 23, the coil 23 is heated as is the PTFE layer 24. PTFE has a very high coefficient of thermal expansion and hence expands rapidly. The coil 23 constructed in a serpentine nature is able to expand substantially with the expansion of the PTFE layer 24. The PTFE layer 24 includes a lip portion 11 that, upon expansion, bends in a scooping motion as previously described. As a result of the scooping motion, the meniscus 5 generally bulges and results in a consequential ejection of a drop of ink. The nozzle chamber 2 is later replenished by means of surface tension effects in drawing ink through an ink supply channel 3 which is etched through the wafer through the utilization of a highly an isotropic silicon trench etcher. Hence, ink can be supplied to the back surface of the wafer and ejected by means of actuation of the actuator 7. The gap between the side arm 8 and chamber wall 9 allows for a substantial breathing effect which results in a low level of energy being required for drop ejection.

It will be appreciated that the lip portion 11 and the actuator 7 together define a displacement surface that acts on the ink to eject the ink from the ink ejection port. The lip portion 11, the actuator 7 and the nozzle rim 4 are configured so that the cross sectional area of the ink ejection port is similar to an area of the displacement surface.

A large number of arrangements 1 of FIG. 5 can be formed together on a wafer with the arrangements being collected into printheads that can be of various sizes in accordance with requirements.

Figure 6:
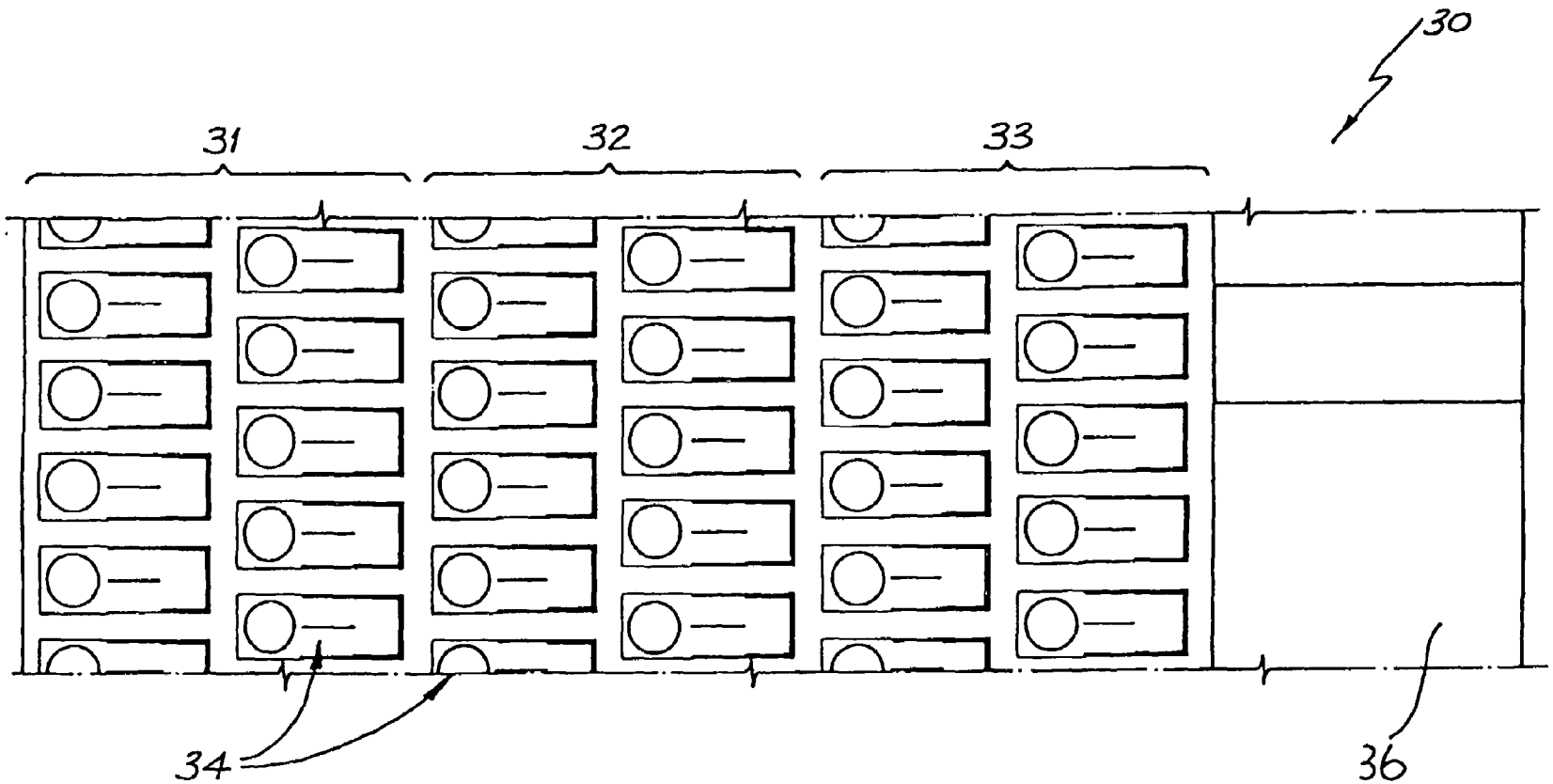
FIG. 6 is a plan view of a portion of a printhead chip of the invention.

In FIG. 6, there is illustrated one form of an array 30 which is designed so as to provide three color printing with each color providing two spaced apart rows of nozzle arrangements 34. The three groupings can comprise groupings 31, 32 and 33 with each grouping supplied with a separate ink color so as to provide for full color printing capability. Additionally, a series of bond pads e.g. 36 are provided for TAB bonding control signals to the printhead 30. Obviously, the arrangement 30 of FIG. 6 illustrates only a portion of a printhead that can be of a length as determined by requirements.

Figure 7:
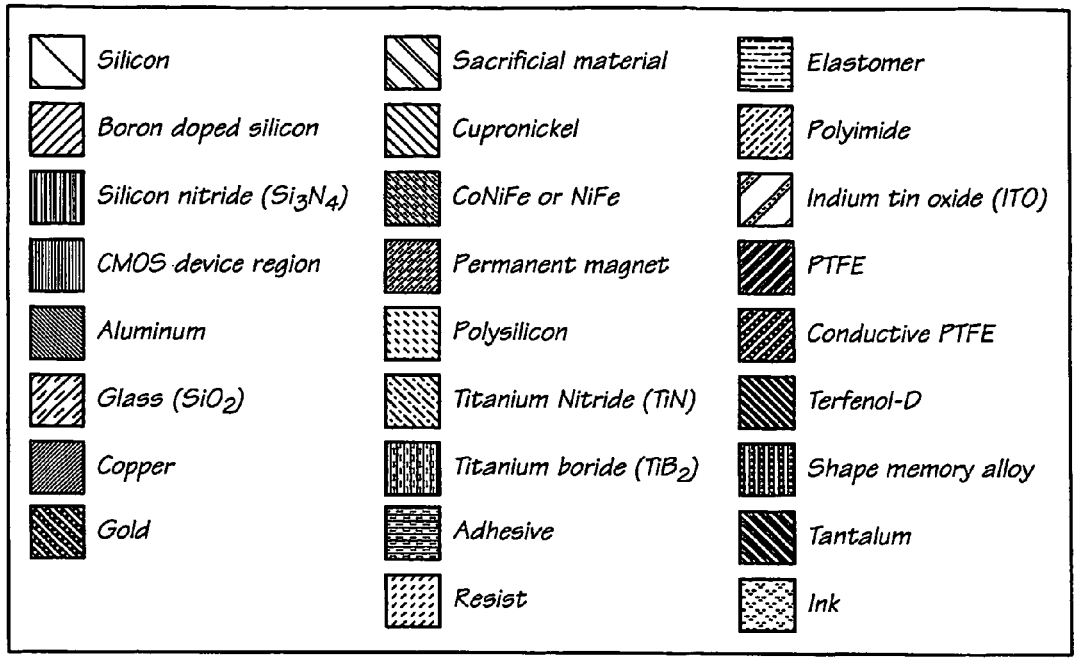
FIG. 7 is a legend of the materials indicated in FIGS. 8 to 16.
Figure 8:
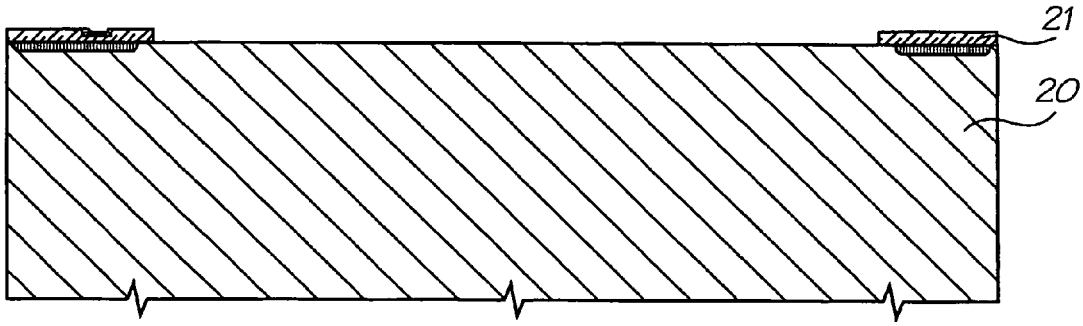
FIG. 8 to FIG. 17 illustrates sectional views of the manufacturing steps in one form of construction of the ink jet printhead chip.

One form of detailed manufacturing process, which can be used to fabricate monolithic ink jet printheads operating in accordance with the principles taught by the present embodiment can proceed utilizing the following steps:

1. Using a double sided polished wafer 20, complete drive transistors, data distribution, and timing circuits using a 0.5 micron, one poly, 2 metal CMOS process 21. Relevant features of the wafer at this step are shown in FIG. 8. For clarity, these diagrams may not be to scale, and may not represent a cross section though any single plane of the nozzle. FIG. 7 is a key to representations of various materials in these manufacturing diagrams, and those of other cross-referenced ink jet configurations.

2. Etch the CMOS oxide layers down to silicon or second level metal using Mask 1. This mask defines the nozzle cavity and the edge of the chips. Relevant features of the wafer at this step are shown in FIG. 8.

Figure 9:
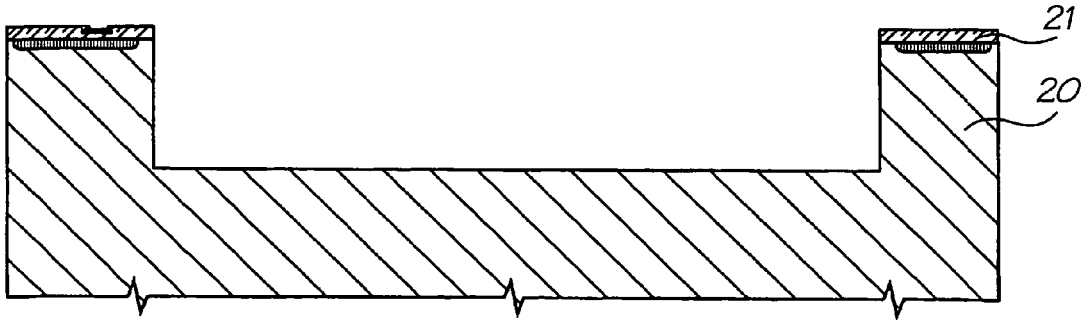

3. Plasma etch the silicon to a depth of 20 microns using the oxide as a mask. This step is shown in FIG. 9.

Figure 10:
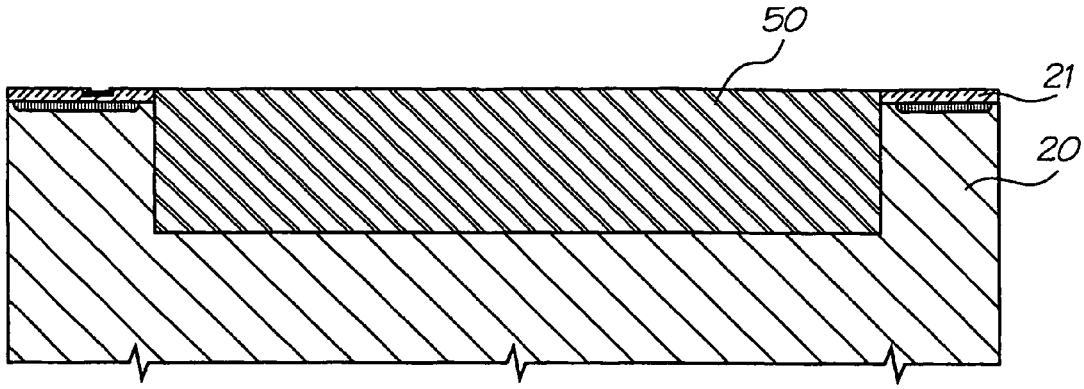

4. Deposit 23 microns of sacrificial material 50 and planarize down to oxide using CMP. This step is shown in FIG. 10.

Figure 11:
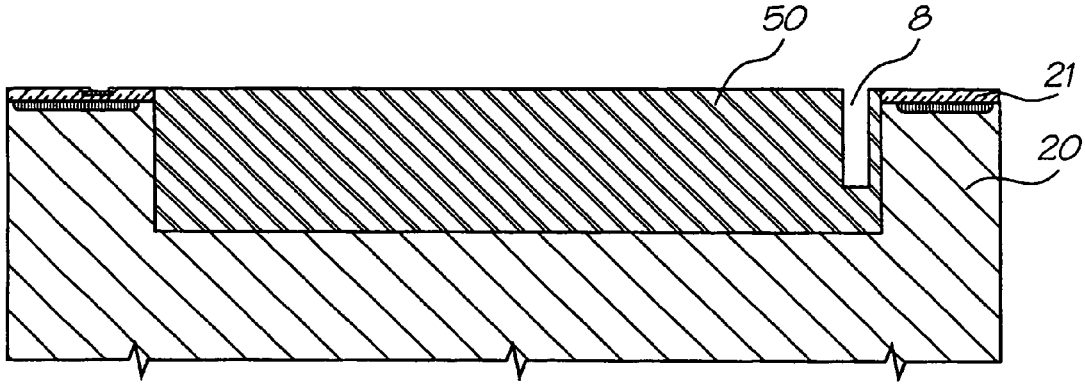

5. Etch the sacrificial material to a depth of 15 microns using Mask 2. This mask defines the vertical paddle 8 at the end of the actuator. This step is shown in FIG. 11.

6. Deposit a thin layer (not shown) of a hydrophilic polymer, and treat the surface of this polymer for PTFE adherence.

7. Deposit 1.5 microns of polytetrafluoroethylene (PTFE) 51.

Figure 12:
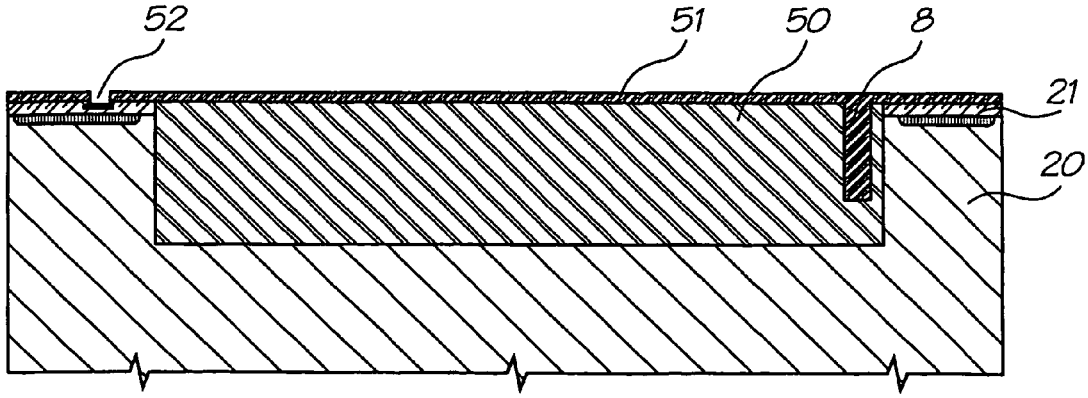

8. Etch the PTFE and CMOS oxide layers to second level metal using Mask 3. This mask defines the contact vias 52 for the heater electrodes. This step is shown in FIG. 12.

Figure 13:
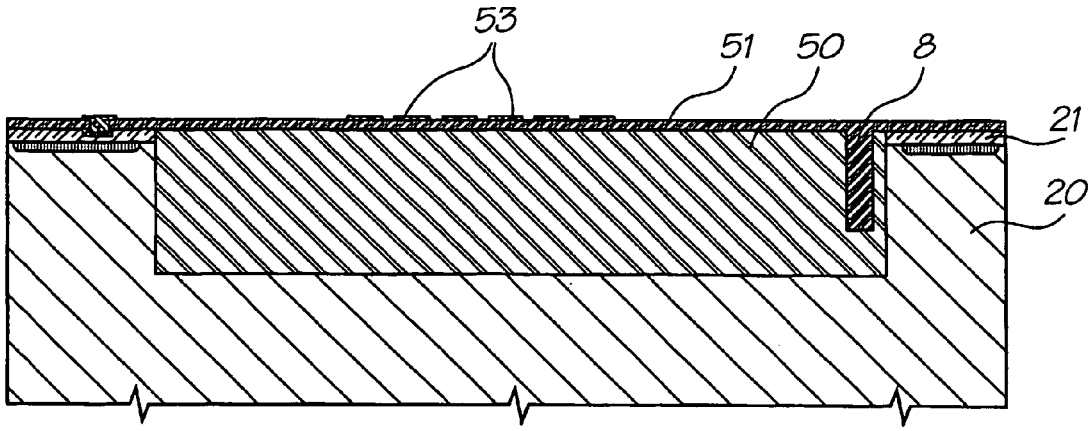

9. Deposit and pattern 0.5 microns of gold 53 using a lift-off process using Mask 4. This mask defines the heater pattern. This step is shown in FIG. 13.

10. Deposit 1.5 microns of PTFE 54.

Figure 14:
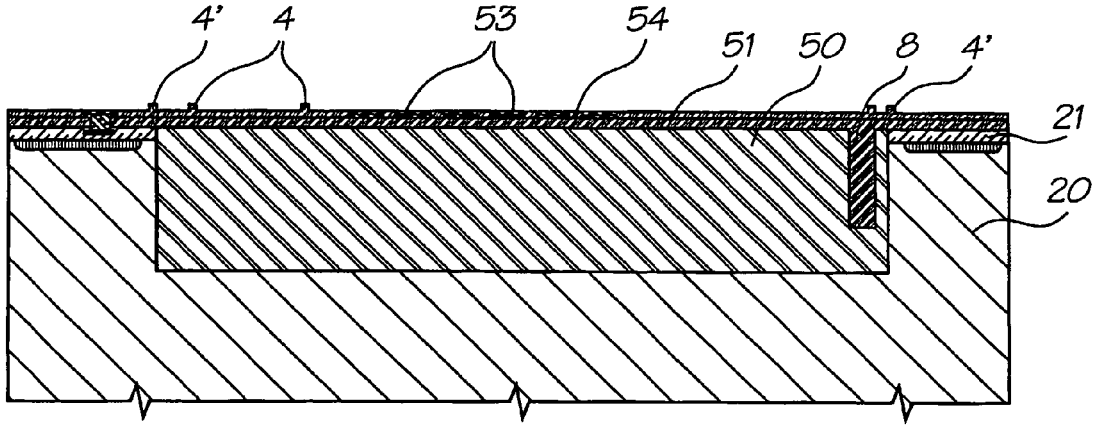

11. Etch 1 micron of PTFE using Mask 5. This mask defines the nozzle rim 4 and the rim 4 at the edge of the nozzle chamber. This step is shown in FIG. 14.

Figure 15:
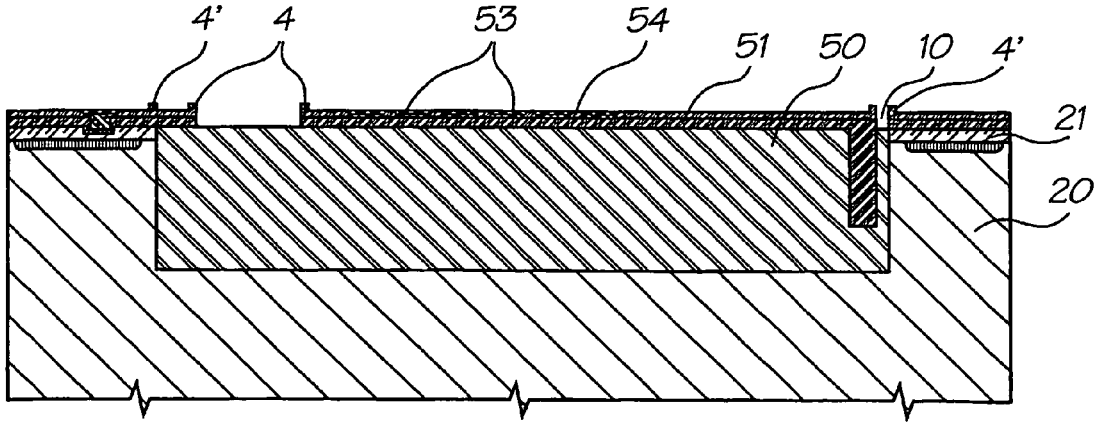

12. Etch both layers of PTFE and the thin hydrophilic layer down to the sacrificial layer using Mask 6. This mask defines the gap 10 at the edges of the actuator and paddle. This step is shown in FIG. 15.

Figure 16:
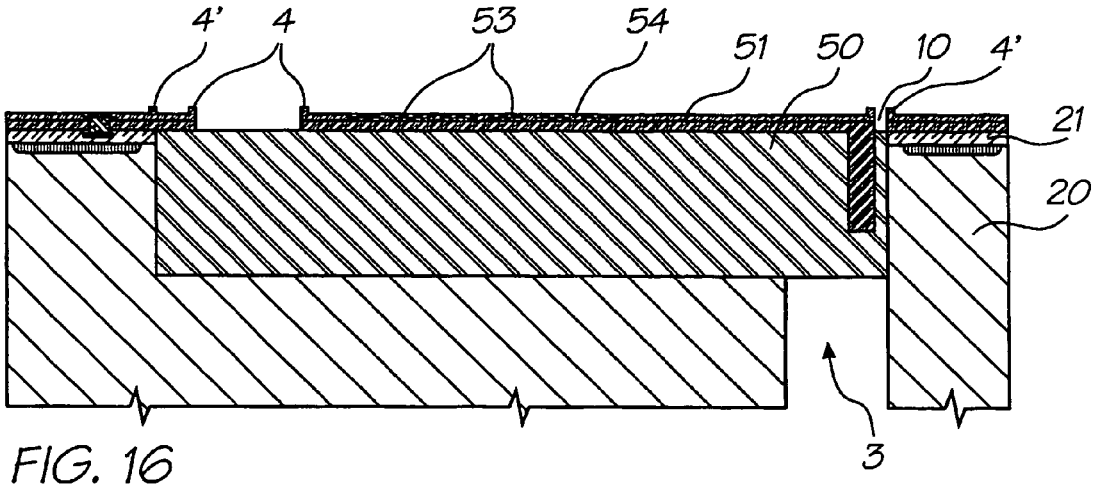

13. Back-etch through the silicon wafer to the sacrificial layer (with, for example, an ASE Advanced Silicon Etcher from Surface Technology Systems) using Mask 7. This mask defines the ink inlets which 3 are etched through the wafer. This step is shown in FIG. 16.

14. Etch the sacrificial layers. The wafer is also diced by this etch.

15. Mount the printheads in their packaging, which may be a molded plastic former incorporating ink channels that supply the appropriate color ink to the ink inlets at the back of the wafer.

16. Connect the printheads to their interconnect systems. For a low profile connection with minimum disruption of airflow, TAB may be used. Wire bonding may also be used if the printer is to be operated with sufficient clearance to the paper.

Figure 17:
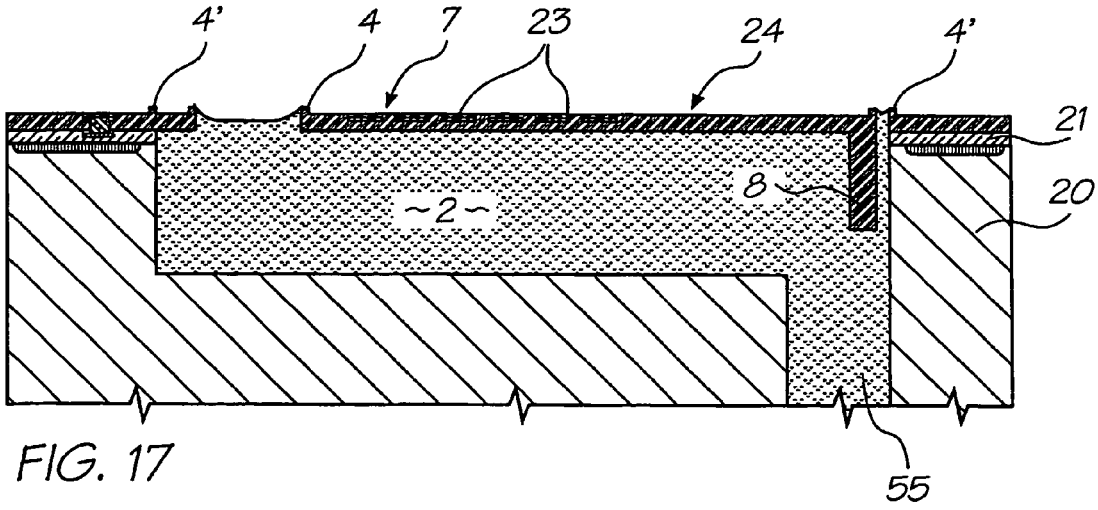

17. Fill the completed printheads with ink 55 and test them. A filled nozzle is shown in FIG. 17.

Figure 18:
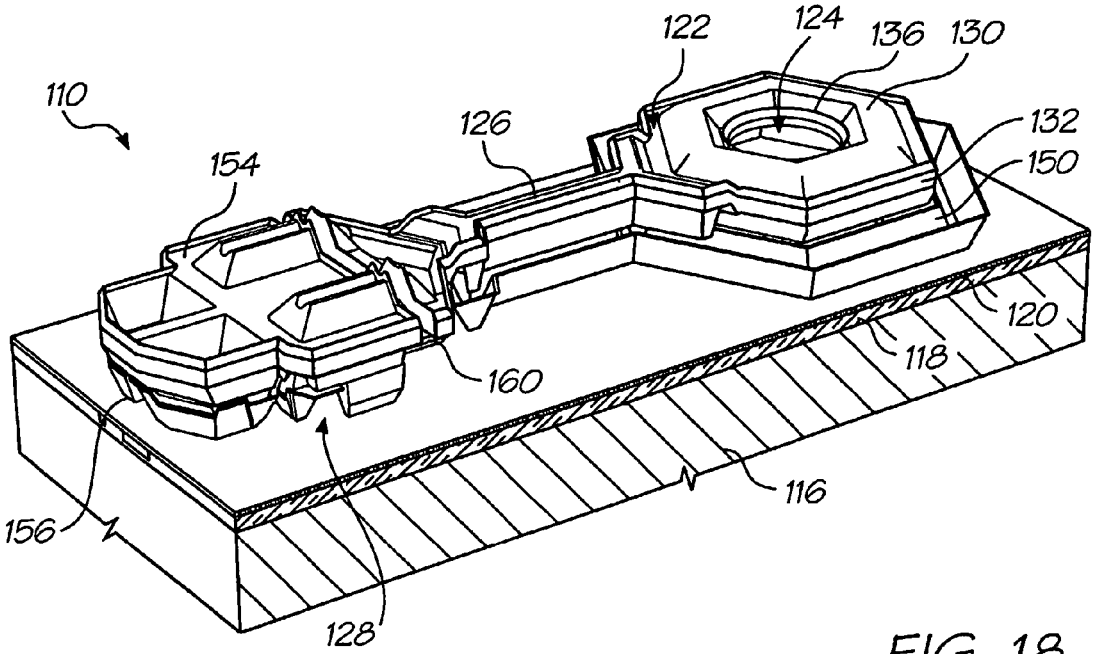
FIG. 18 shows a three dimensional, schematic view of a nozzle arrangement for another ink jet printhead chip of the invention.

In FIG. 18 of the drawings, a nozzle arrangement of another embodiment of the printhead chip of the invention is designated generally by the reference numeral 110. The printhead chip has a plurality of the nozzle arrangements 110 arranged in an array 114 (FIGS. 22 and 23) on a silicon substrate 116. The array 114 will be described in greater detail below.

The nozzle arrangement 110 includes a silicon substrate or wafer 116 on which a dielectric layer 118 is deposited. A CMOS passivation layer 120 is deposited on the dielectric layer 118. Each nozzle arrangement 110 includes a nozzle 122 defining an ink ejection port 124, a connecting member in the form of a lever arm 126 and an actuator 128. The lever arm 126 connects the actuator 128 to the nozzle 122.

Figure 19:
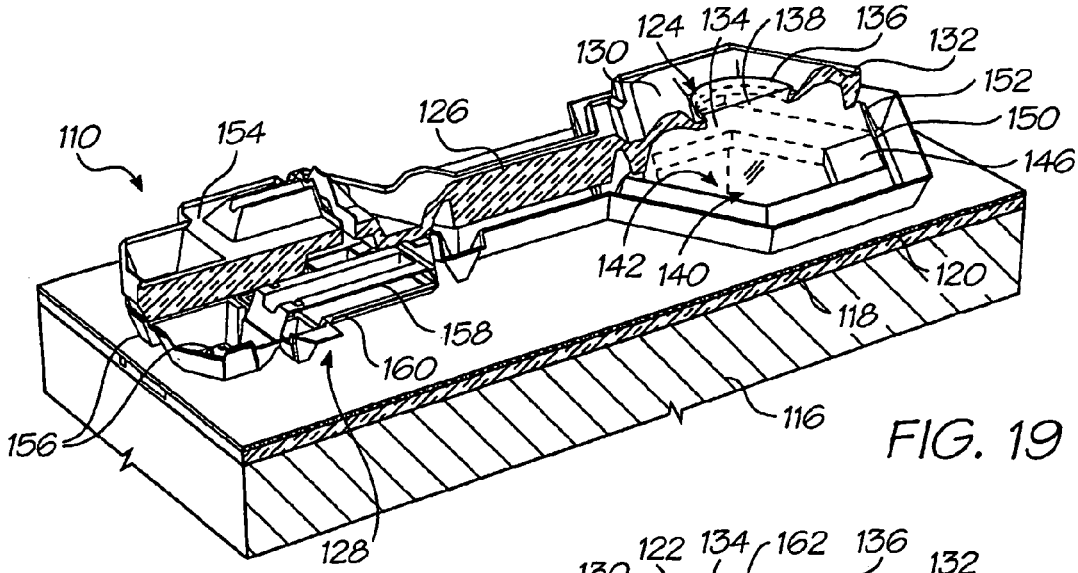
FIGS. 19 to 21 show a three dimensional, schematic illustration of an operation of the nozzle arrangement of FIG. 18.
Figure 20:
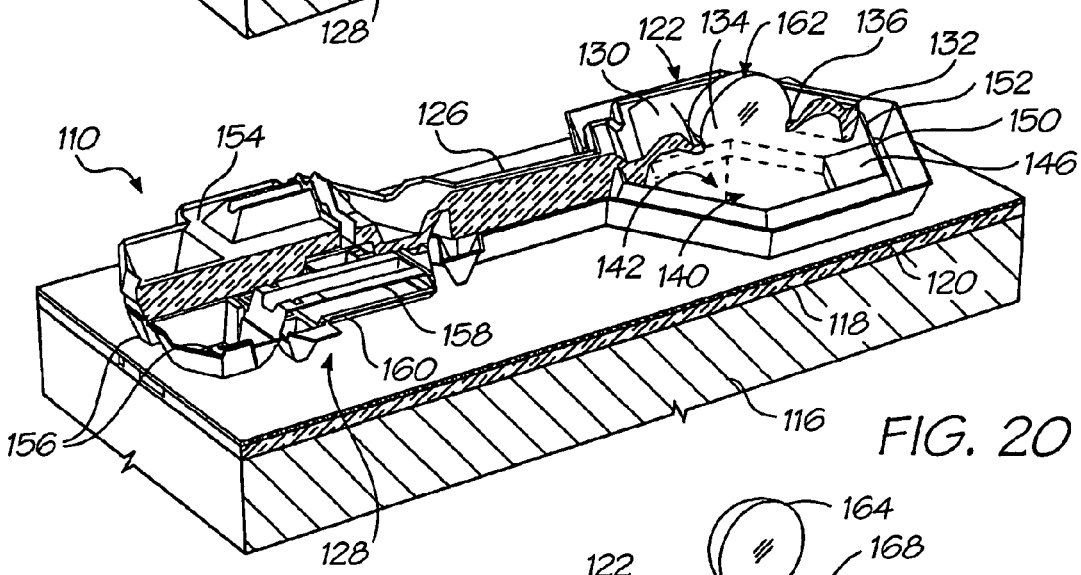
Figure 21:
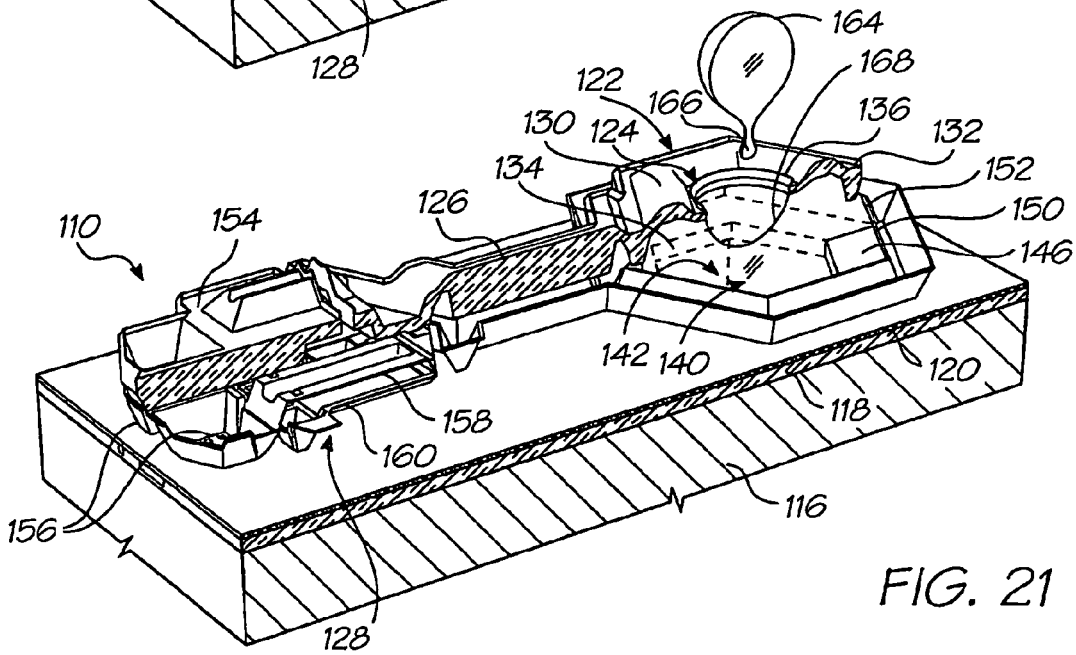

As shown in greater detail in FIGS. 19 to 21 of the drawings, the nozzle 122 comprises a crown portion 130 with a skirt portion 132 depending from the crown portion 130. The skirt portion 132 forms part of a peripheral wall of a nozzle chamber 134 (FIGS. 19 to 21 of the drawings). The ink ejection port 124 is in fluid communication with the nozzle chamber 134. It is to be noted that the ink ejection port 124 is surrounded by a raised rim 136 that "pins" a meniscus 138 (FIG. 19) of a body of ink 140 in the nozzle chamber 134.

An ink inlet aperture 142 (shown most clearly in FIG. 23) is defined in a floor 146 of the nozzle chamber 134. The aperture 142 is in fluid communication with an ink inlet channel 148 defined through the substrate 116.

A wall portion 150 bounds the aperture 142 and extends upwardly from the floor portion 146. The skirt portion 132, as indicated above, of the nozzle 122 defines a first part of a peripheral wall of the nozzle chamber 134 and the wall portion 150 defines a second part of the peripheral wall of the nozzle chamber 134.

The wall 150 has an inwardly directed lip 152 at its free end, which serves as a fluidic seal that inhibits the escape of ink when the nozzle 122 is displaced, as will be described in greater detail below. It will be appreciated that, due to the viscosity of the ink 140 and the small dimensions of the spacing between the lip 152 and the skirt portion 132, the inwardly directed lip 152 and surface tension function as a seal for inhibiting the escape of ink from the nozzle chamber 134.

The actuator 128 is a thermal bend actuator and is connected to an anchor 154 extending upwardly from the substrate 116 or, more particularly, from the CMOS passivation layer 120. The anchor 154 is mounted on conductive pads 156 which form an electrical connection with the actuator 128.

The actuator 128 comprises a first, active beam 158 arranged above a second, passive beam 160. In a preferred embodiment, both beams 158 and 160 are of, or include, a conductive ceramic material such as titanium nitride (TiN).

Both beams 158 and 160 have their first ends anchored to the anchor 154 and their opposed ends connected to the arm 126. When a current is caused to flow through the active beam 158 thermal expansion of the beam 158 results. As the passive beam 160, through which there is no current flow, does not expand at the same rate, a bending moment is created causing the arm 126 and, hence, the nozzle 122 to be displaced downwardly towards the substrate 116 as shown in FIG. 20 of the drawings. This causes an ejection of ink through the nozzle opening 124 as shown at 162 in FIG. 20 of the drawings. When the source of heat is removed from the active beam 158, i.e. by stopping current flow, the nozzle 122 returns to its quiescent position as shown in FIG. 21 of the drawings. When the nozzle 122 returns to its quiescent position, an ink droplet 164 is formed as a result of the breaking of an ink droplet neck as illustrated at 166 in FIG. 21 of the drawings. The ink droplet 164 then travels on to the print media such as a sheet of paper. As a result of the formation of the ink droplet 164, a "negative" meniscus is formed as shown at 168 in FIG. 21 of the drawings. This "negative" meniscus 168 results in an inflow of ink 140 into the nozzle chamber 134 such that a new meniscus 138 (FIG. 19) is formed in readiness for the next ink drop ejection from the nozzle arrangement 110.

It will be appreciated that the crown portion 130 defines a displacement surface which acts on the ink in the nozzle chamber 134. The crown portion 130 is configured so that an area of the displacement surface is greater than half but less than twice a cross sectional area of the ink ejection port 124.

Figure 22:
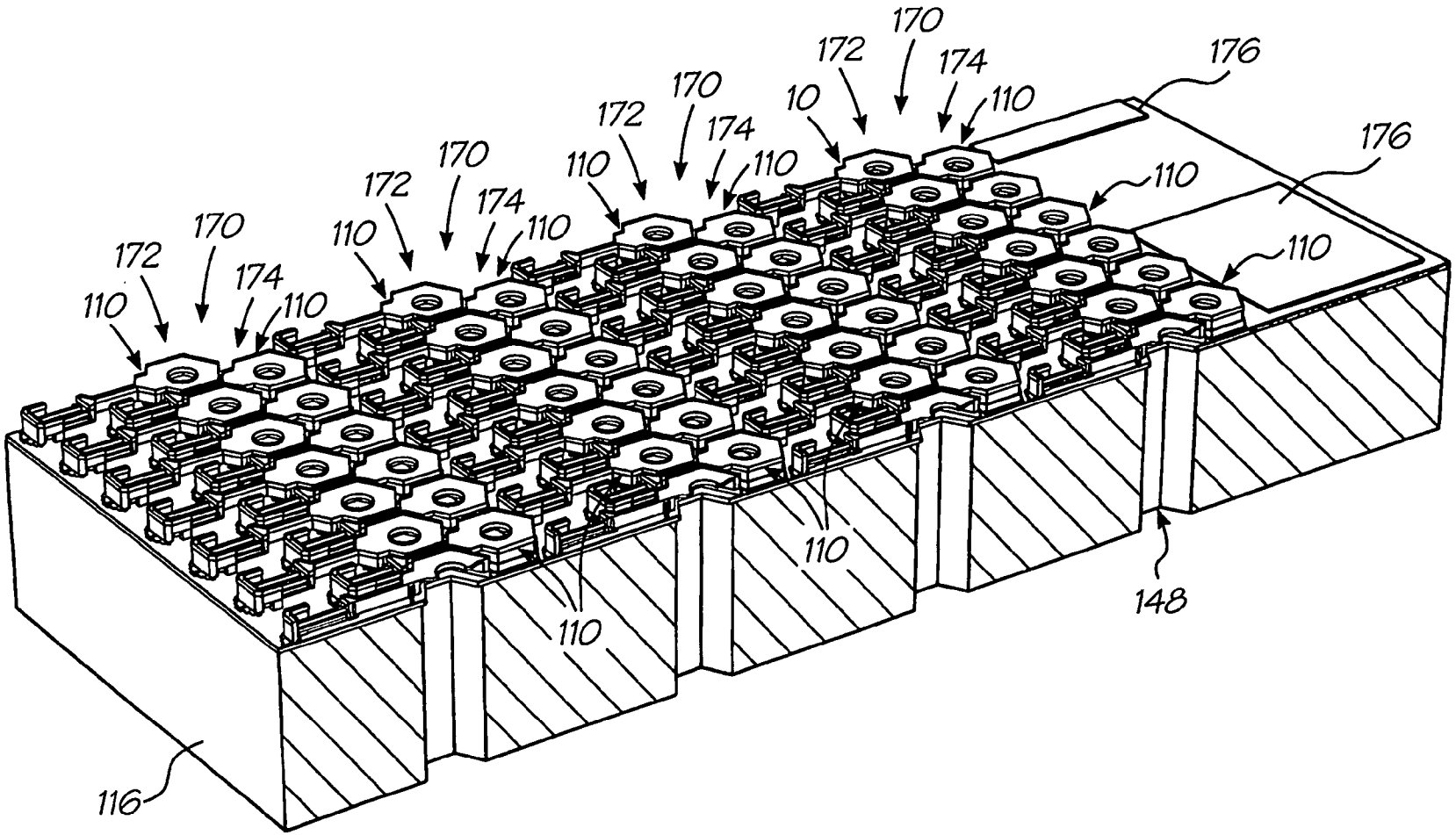
FIG. 22 shows a three dimensional view of part of the printhead chip of FIG. 18.
Figure 23:
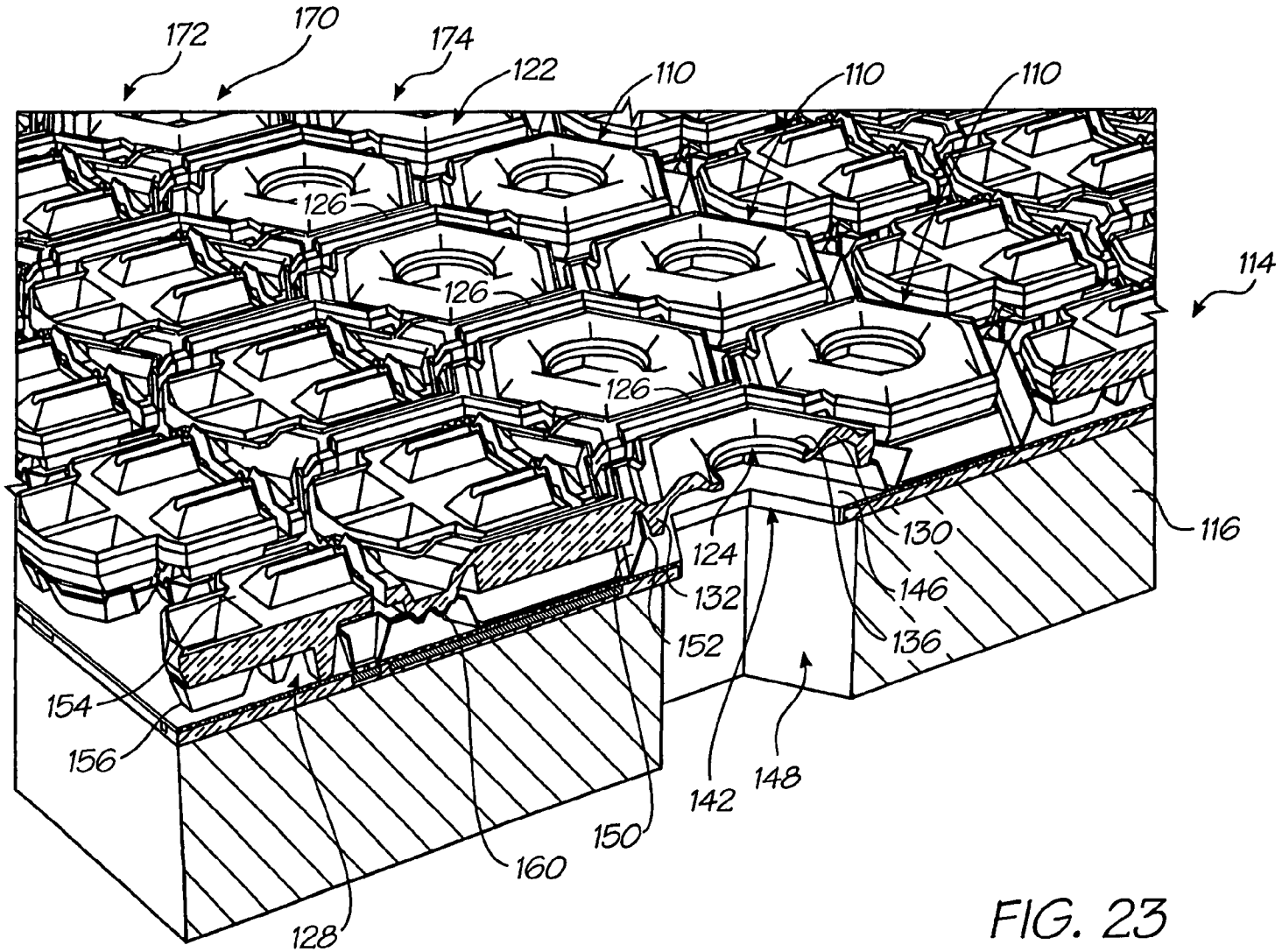
FIG. 23 shows a detailed portion of the printhead chip of FIG. 18.

Referring now to FIGS. 22 and 23 of the drawings, the nozzle array 114 is described in greater detail. The array 114 is for a four-color printhead. Accordingly, the array 114 includes four groups 170 of nozzle arrangements, one for each color. Each group 170 has its nozzle arrangements 110 arranged in two rows 172 and 174. One of the groups 170 is shown in greater detail in FIG. 23 of the drawings.

To facilitate close packing of the nozzle arrangements 110 in the rows 172 and 174, the nozzle arrangements 110 in the row 174 are offset or staggered with respect to the nozzle arrangements 110 in the row 172. Also, the nozzle arrangements 110 in the row 172 are spaced apart sufficiently far from each other to enable the lever arms 126 of the nozzle arrangements 110 in the row 174 to pass between adjacent nozzles 122 of the arrangements 110 in the row 172. It is to be noted that each nozzle arrangement 110 is substantially dumbbell shaped so that the nozzles 122 in the row 172 nest between the nozzles 122 and the actuators 128 of adjacent nozzle arrangements 110 in the row 174.

Further, to facilitate close packing of the nozzles 122 in the rows 172 and 174, each nozzle 122 is substantially hexagonally shaped.

It will be appreciated by those skilled in the art that, when the nozzles 122 are displaced towards the substrate 116, in use, due to the nozzle opening 124 being at a slight angle with respect to the nozzle chamber 134 ink is ejected slightly off the perpendicular. It is an advantage of the arrangement shown in FIGS. 22 and 23 of the drawings that the actuators 128 of the nozzle arrangements 110 in the rows 172 and 174 extend in the same direction to one side of the rows 172 and 174. Hence, the ink droplets ejected from the nozzles 122 in the row 172 and the ink droplets ejected from the nozzles 122 in the row 174 are parallel to one another resulting in an improved print quality.

Also, as shown in FIG. 22 of the drawings, the substrate 116 has bond pads 176 arranged thereon which provide the electrical connections, via the pads 156, to the actuators 128 of the nozzle arrangements 110. These electrical connections are formed via the CMOS layer (not shown).

Figure 24:
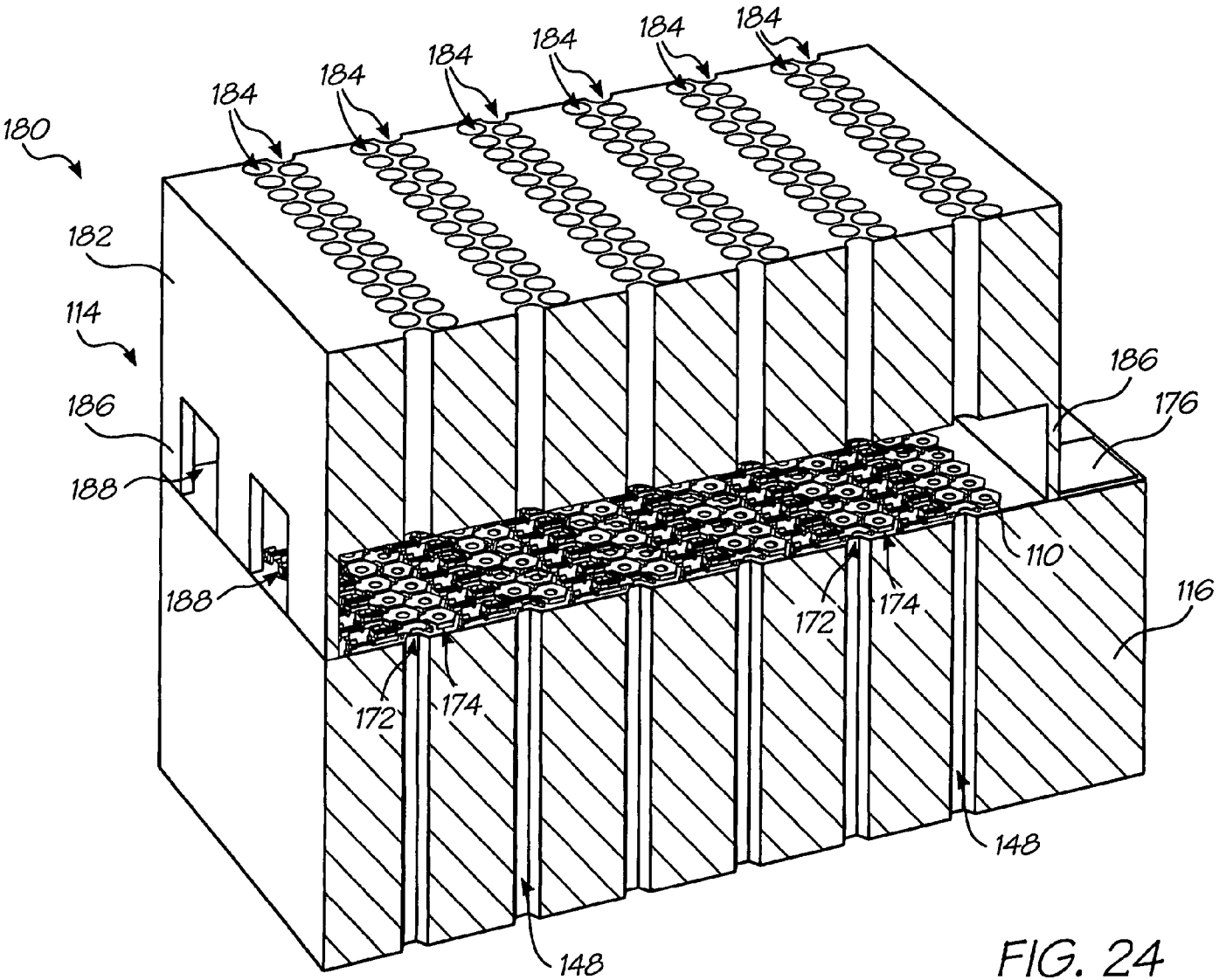
FIG. 24 shows a three dimensional view sectioned view of the ink jet printhead chip of FIG. 18 with a nozzle guard.
Figure 26A:
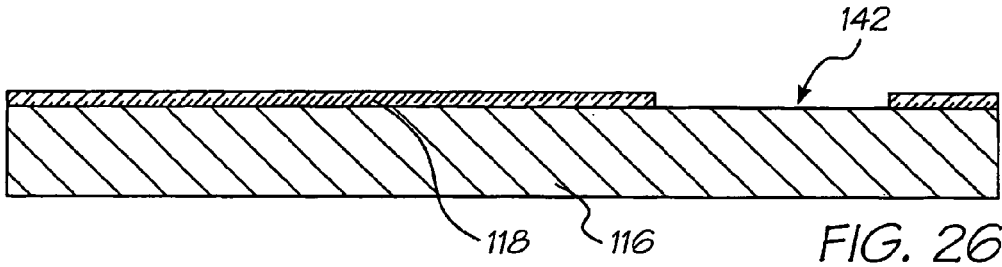
FIGS. 26*a* to 26*r* show side sectioned views of steps in the manufacture of a nozzle arrangement of the ink jet printhead chip of FIG. 18.
Figure 27A:
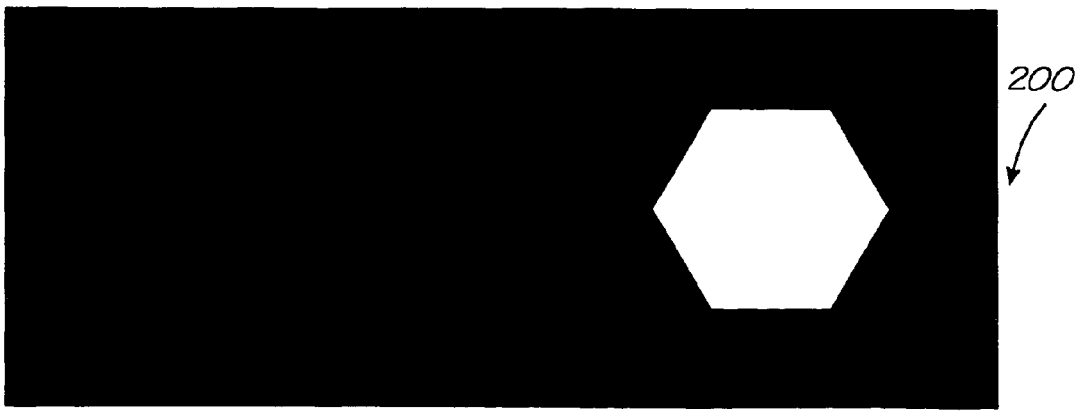
FIGS. 27*a* to 27*k* show masks used in various steps in the manufacturing process.

Referring to FIG. 24 of the drawings, a development of the invention is shown. With reference to the previous drawings, like reference numerals refer to like parts, unless otherwise specified.

In this development, a nozzle guard 180 is mounted on the substrate 116 of the array 114. The nozzle guard 180 includes a body member 182 having a plurality of passages 184 defined therethrough. The passages 184 are in register with the nozzle openings 124 of the nozzle arrangements 110 of the array 114 such that, when ink is ejected from any one of the nozzle openings 124, the ink passes through the associated passage 184 before striking the print media.

The body member 182 is mounted in spaced relationship relative to the nozzle arrangements 110 by limbs or struts 186. One of the struts 186 has air inlet openings 188 defined therein.

In use, when the array 114 is in operation, air is charged through the inlet openings 188 to be forced through the passages 184 together with ink travelling through the passages 184.

The ink is not entrained in the air as the air is charged through the passages 184 at a different velocity from that of the ink droplets 164. For example, the ink droplets 164 are ejected from the nozzles 122 at a velocity of approximately 3 m/s. The air is charged through the passages 184 at a velocity of approximately 1 m/s.

The purpose of the air is to maintain the passages 184 clear of foreign particles. A danger exists that these foreign particles, such as dust particles, could fall onto the nozzle arrangements 110 adversely affecting their operation. With the provision of the air inlet openings 188 in the nozzle guard 180 this problem is, to a large extent, obviated.

Referring now to FIGS. 25 to 27 of the drawings, a process for manufacturing the nozzle arrangements 110 is described.

Starting with the silicon substrate or wafer 116, the dielectric layer 118 is deposited on a surface of the wafer 116. The dielectric layer 118 is in the form of approximately 1.5 microns of CVD oxide. Resist is spun on to the layer 118 and the layer 118 is exposed to mask 200 and is subsequently developed.

After being developed, the layer 118 is plasma etched down to the silicon layer 116. The resist is then stripped and the layer 118 is cleaned. This step defines the ink inlet aperture 142.

Figure 25A:
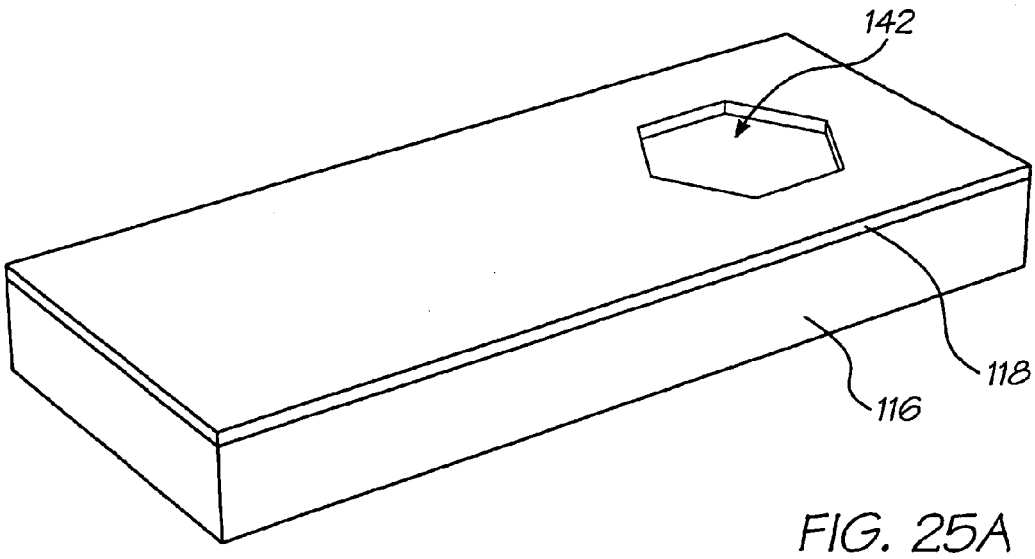
FIGS. 25*a* to 25*r* show three-dimensional views of steps in the manufacture of a nozzle arrangement of the ink jet printhead chip of FIG. 18.
Figure 25B:
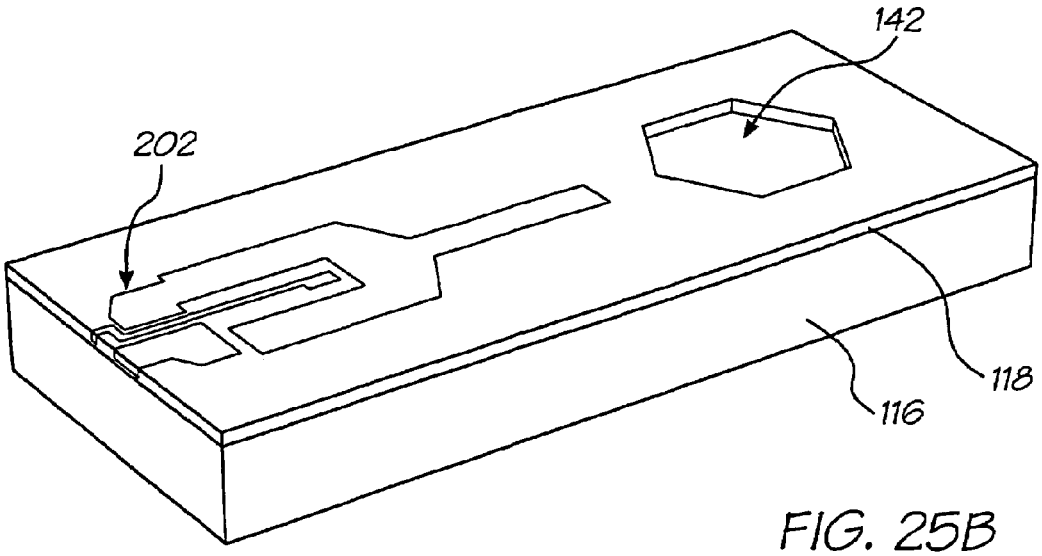
Figure 26B:
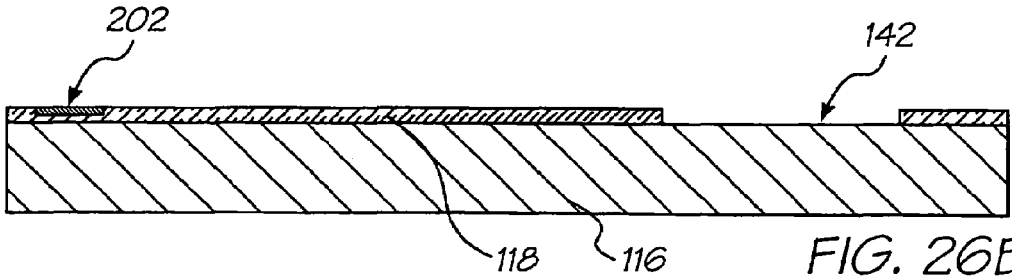
Figure 27B:
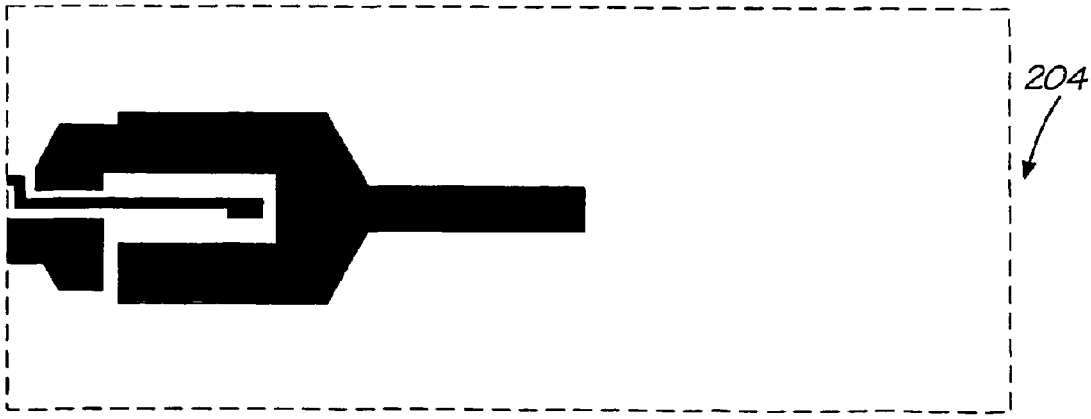
Figure 25C:
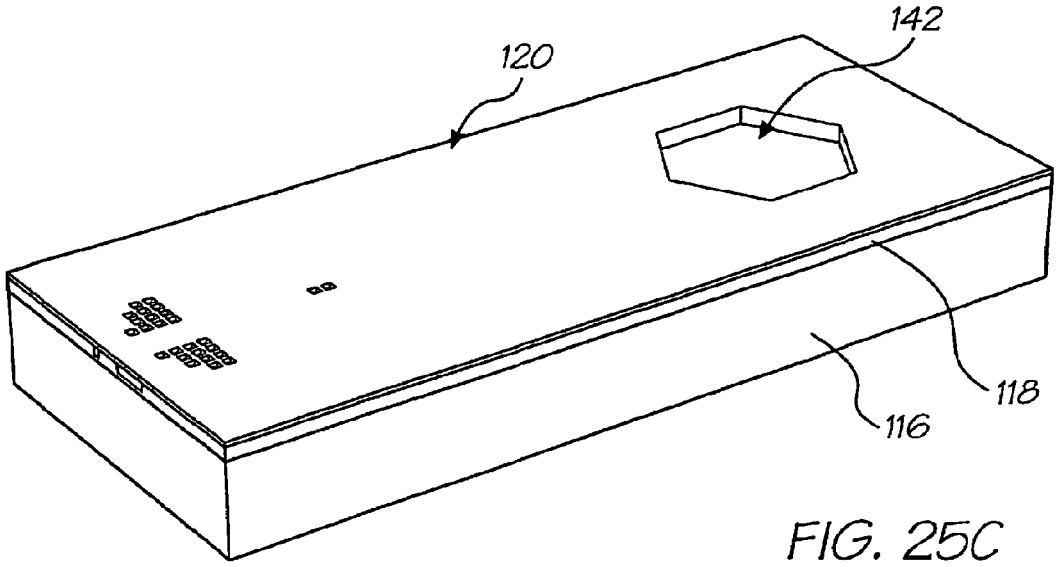
Figure 26C:
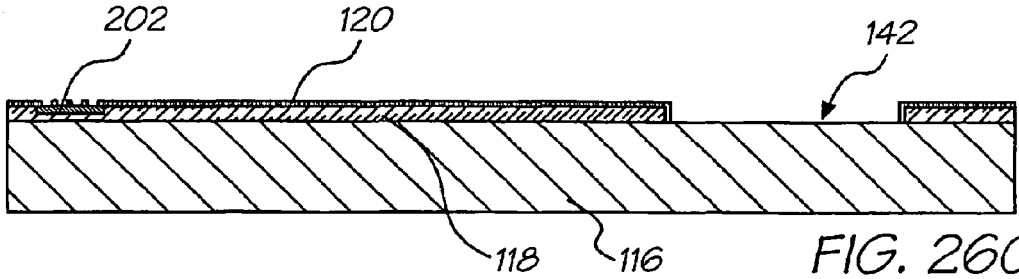
Figure 27C:
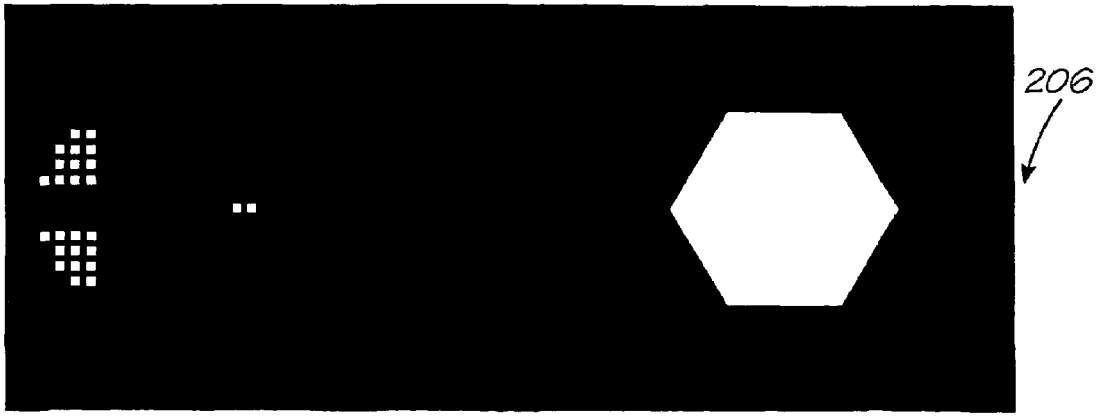
Figure 25D:
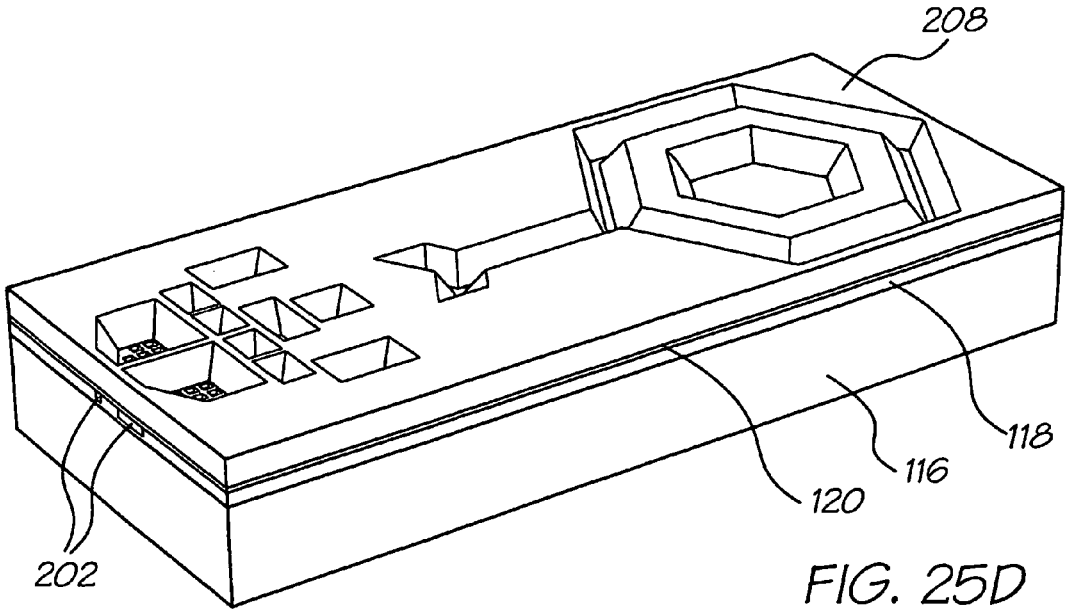
Figure 26D:
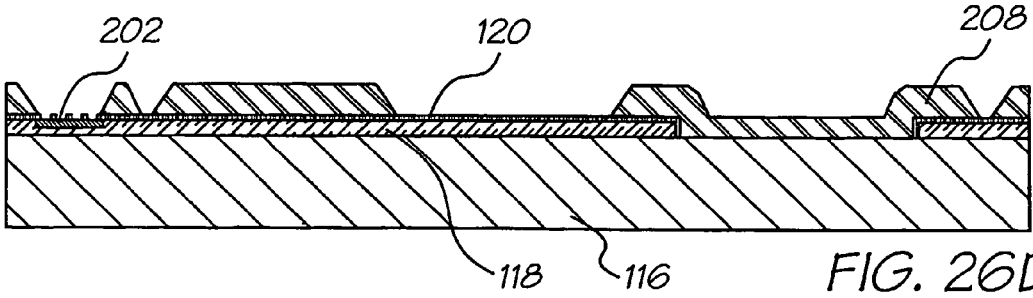
Figure 27D:
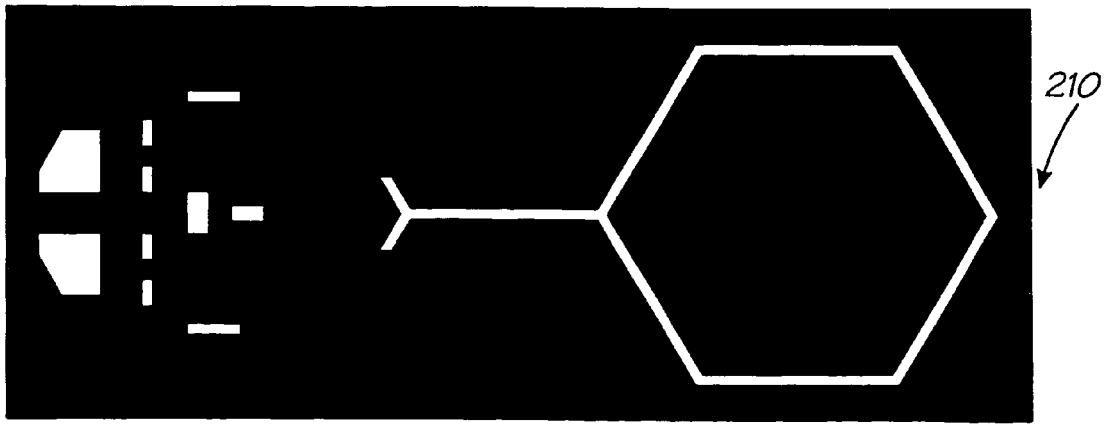

In FIG. 25*b* of the drawings, approximately 0.8 microns of aluminum 202 is deposited on the layer 118. Resist is spun on and the aluminum 202 is exposed to mask 204 and developed. The aluminum 202 is plasma etched down to the oxide layer 118, the resist is stripped and the device is cleaned. This step provides the bond pads and interconnects to the ink jet actuator 128. This interconnect is to an NMOS drive transistor and a power plane with connections made in the CMOS layer (not shown).

Approximately 0.5 microns of PECVD nitride is deposited as the CMOS passivation layer 120. Resist is spun on and the layer 120 is exposed to mask 206 whereafter it is developed. After development, the nitride is plasma etched down to the aluminum layer 202 and the silicon layer 116 in the region of the inlet aperture 142. The resist is stripped and the device cleaned.

A layer 208 of a sacrificial material is spun on to the layer 120. The layer 208 is 6 microns of photosensitive polyimide or approximately 4 μm of high temperature resist. The layer 208 is softbaked and is then exposed to mask 210 whereafter it is developed. The layer 208 is then hardbaked at 400° C. for one hour where the layer 208 is comprised of polyimide or at greater than 300° C. where the layer 208 is high temperature resist. It is to be noted in the drawings that the pattern-dependent distortion of the polyimide layer 208 caused by shrinkage is taken into account in the design of the mask 210.

Figure 25E:
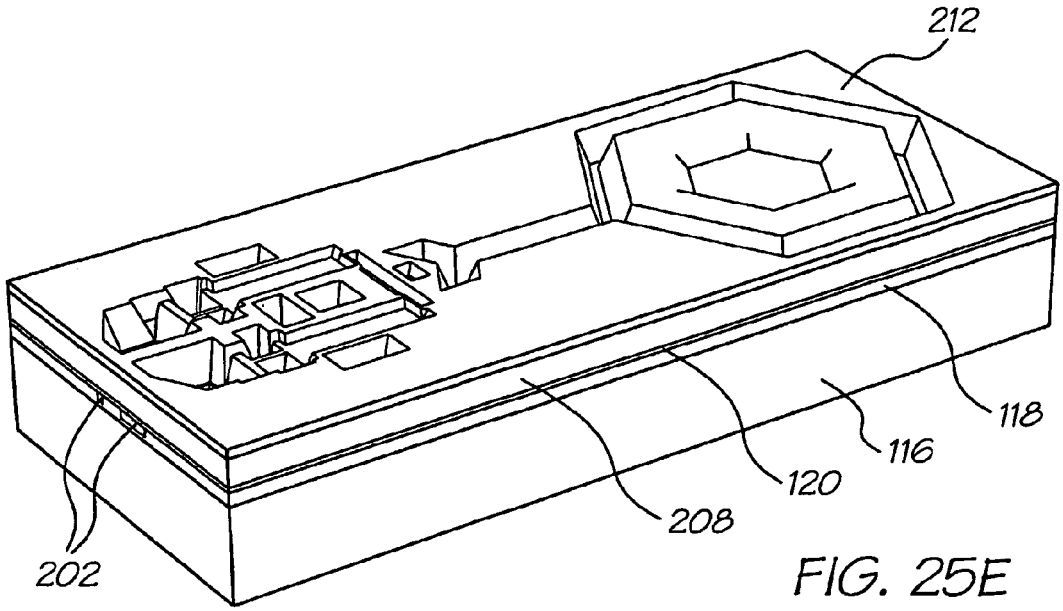
Figure 27E:
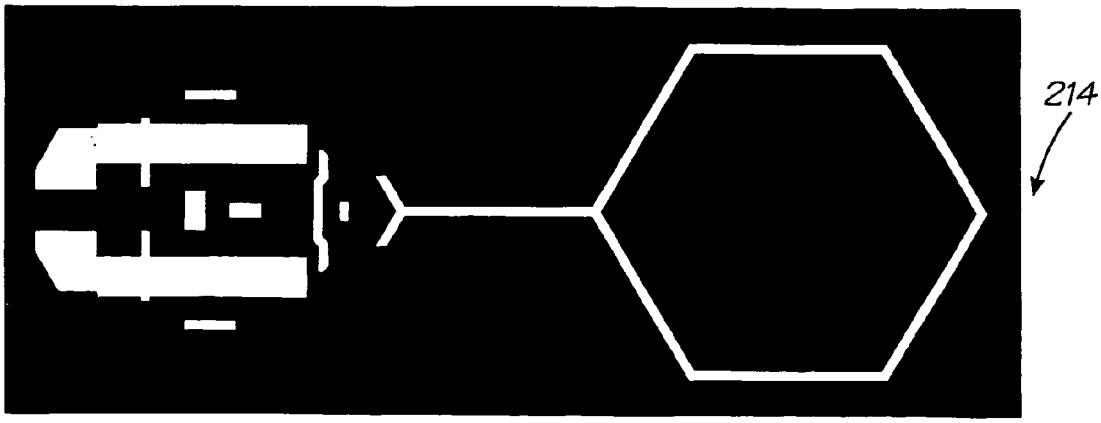
Figure 25F:
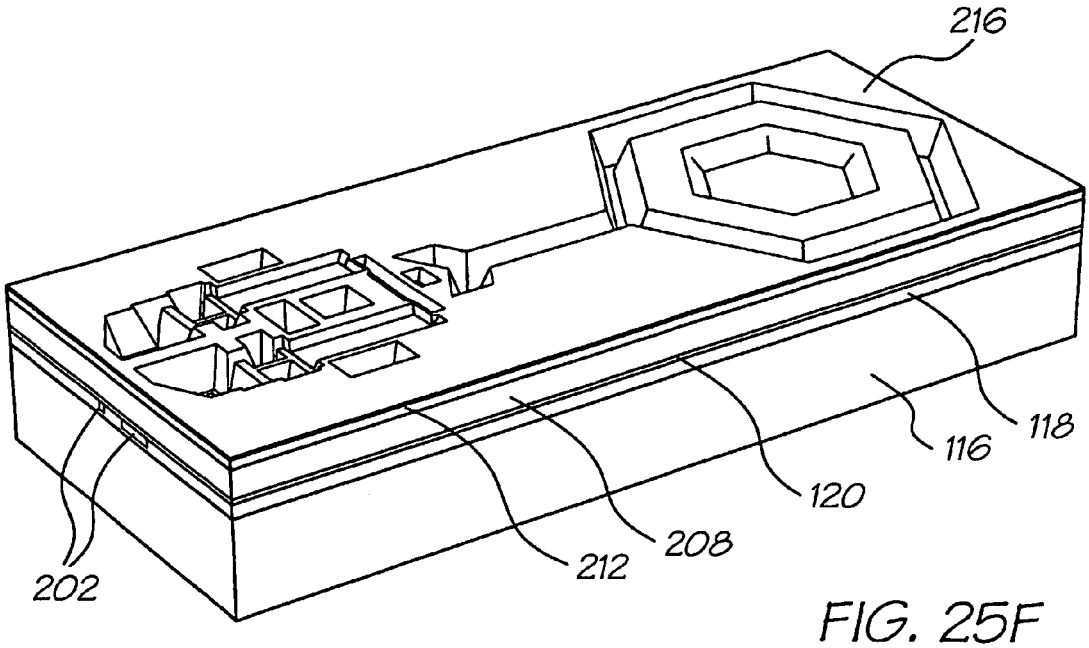
Figure 25G:
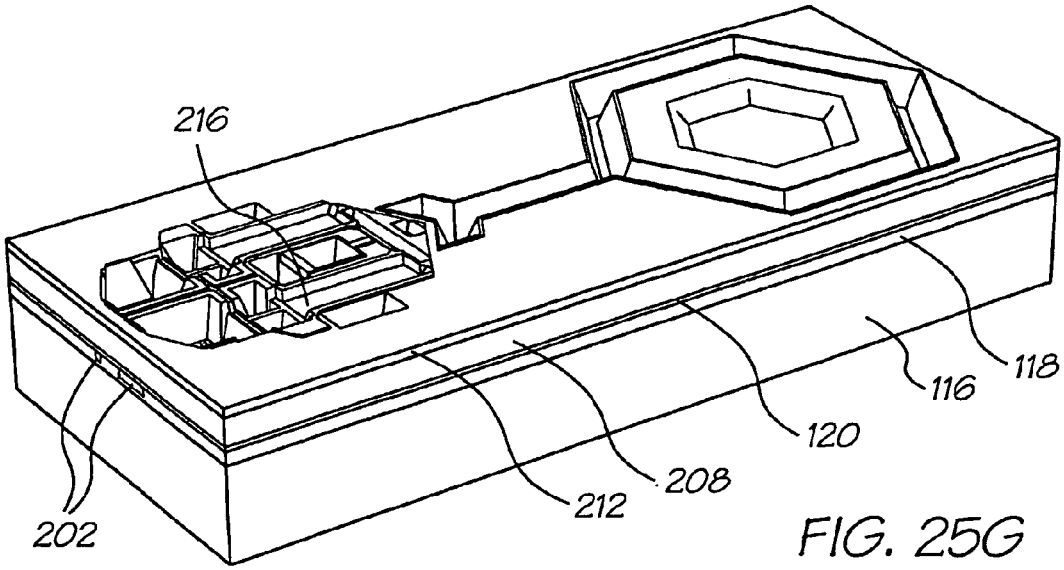
Figure 27F:
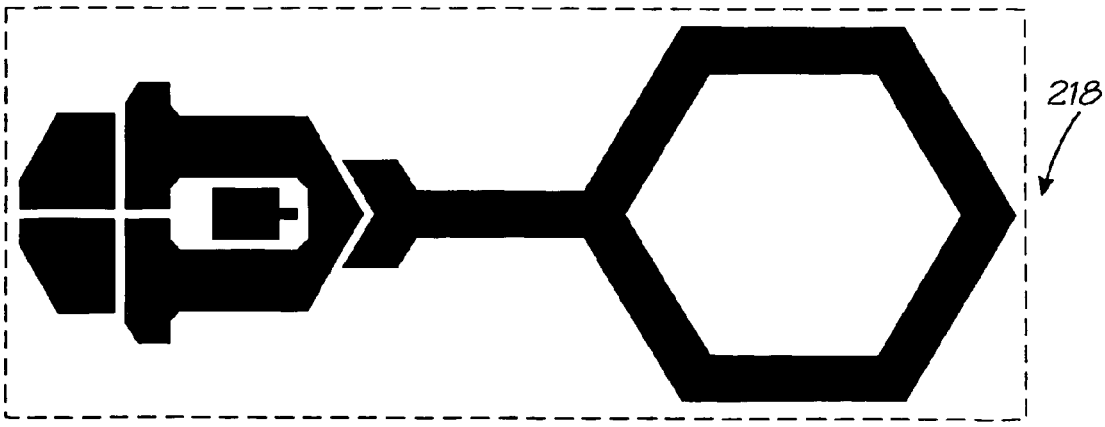
Figure 25H:
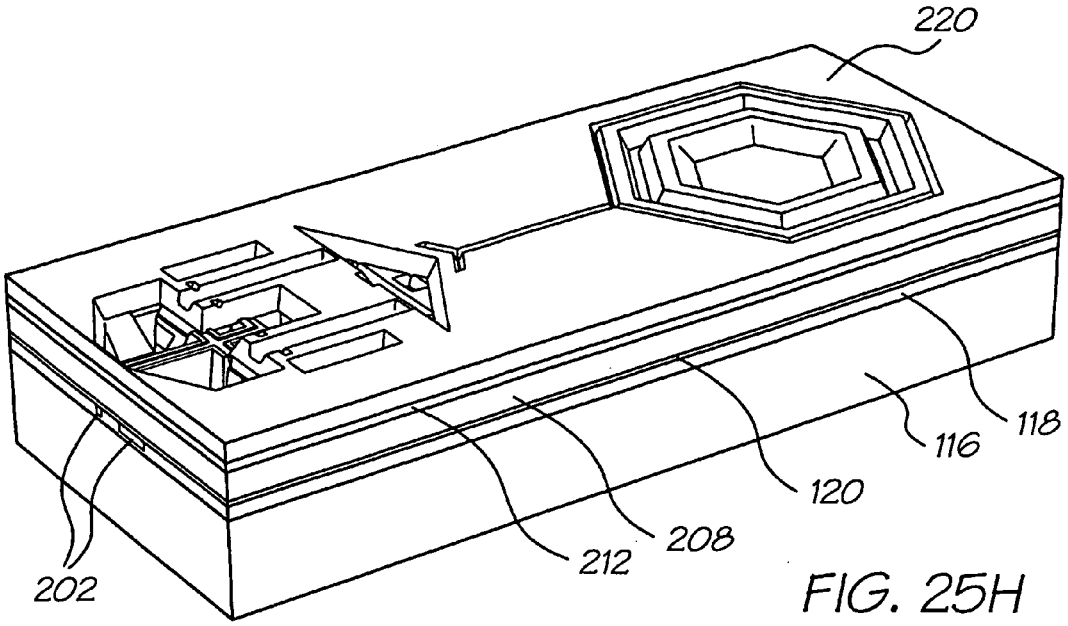
Figure 27G:
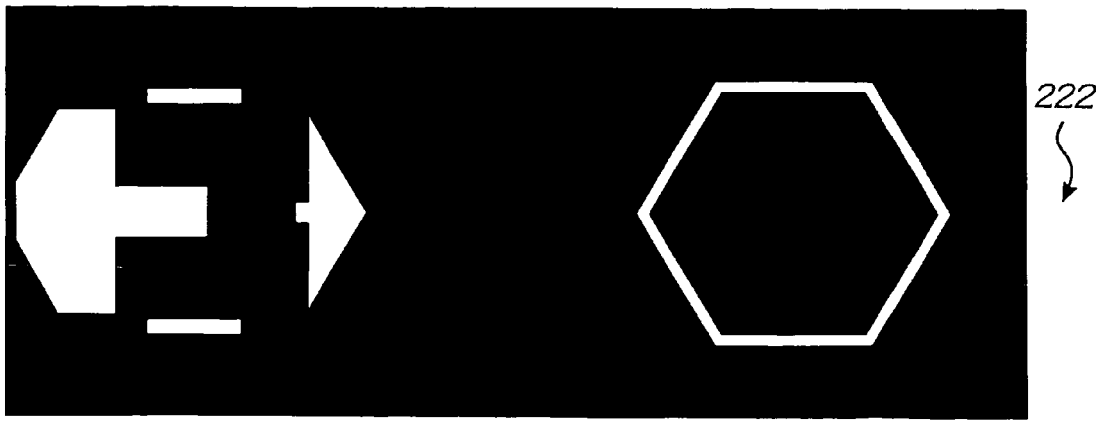
Figure 25I:
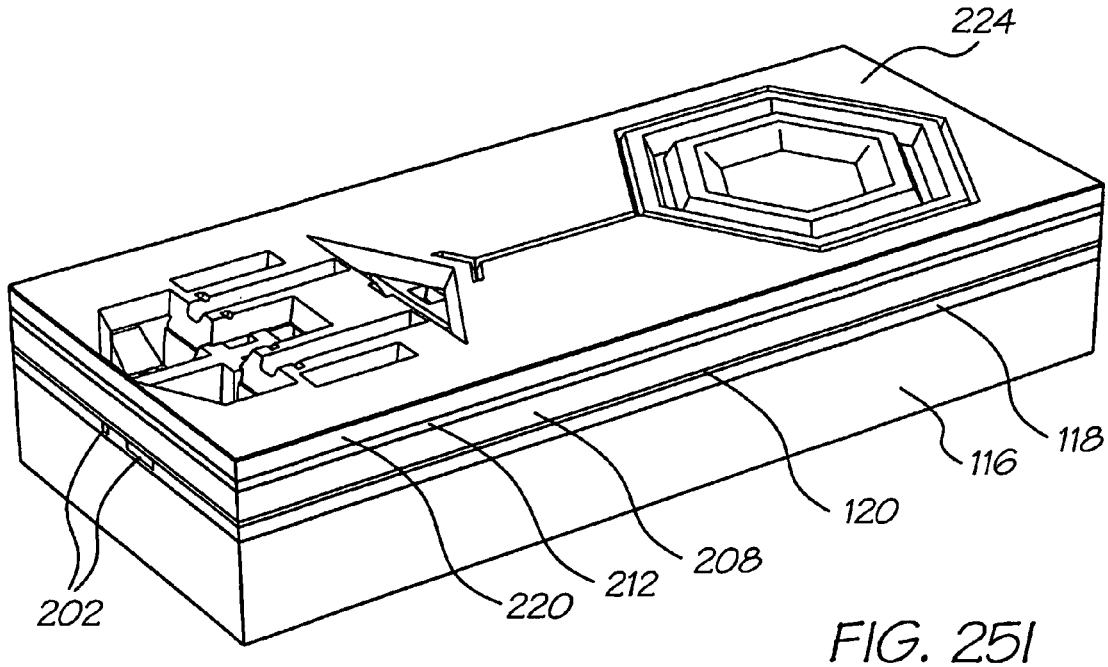
Figure 25J:
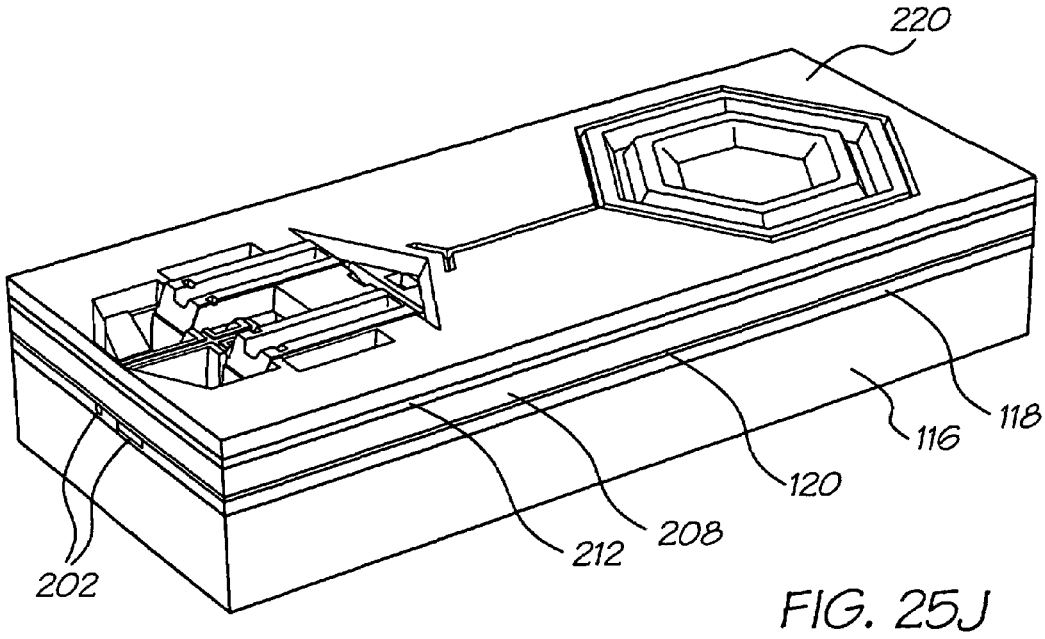
Figure 27H:
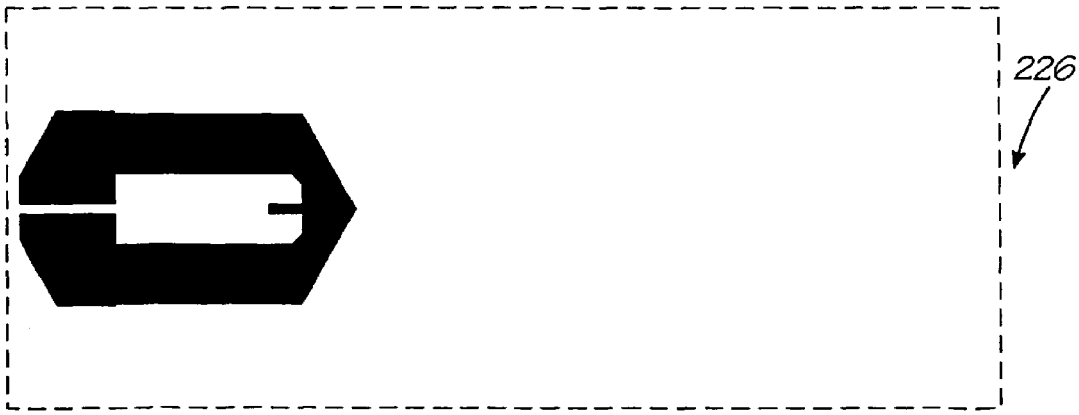
Figure 25K:
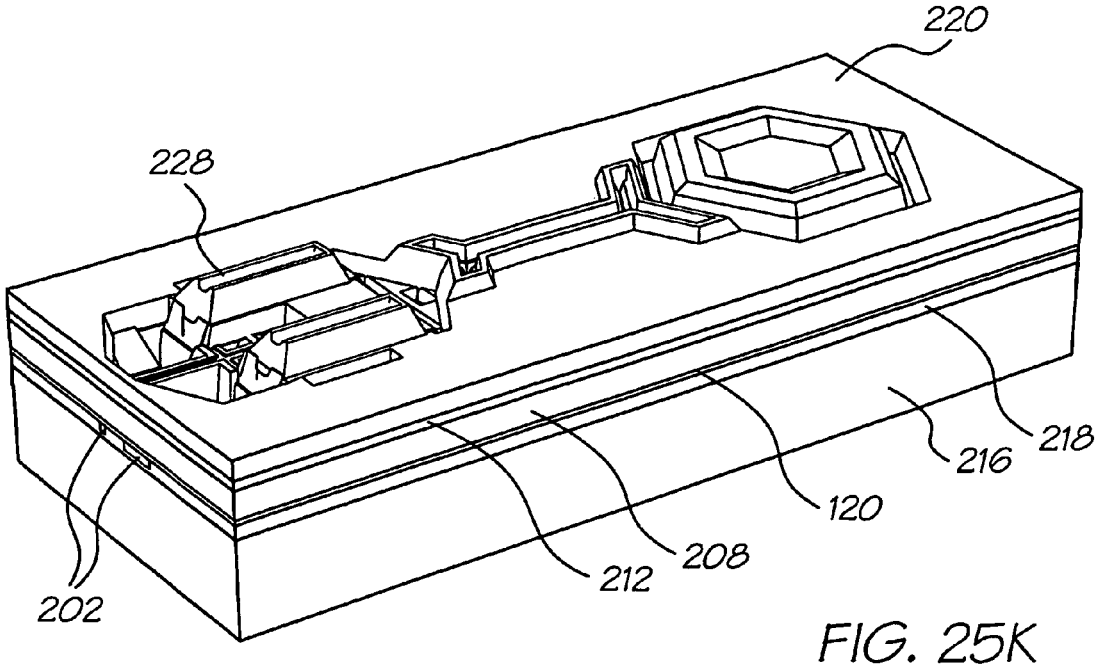

In the next step, shown in FIG. 25*e* of the drawings, a second sacrificial layer 212 is applied. The layer 212 is either 2 μm of photosensitive polyimide, which is spun on, or approximately 1.3 μm of high temperature resist. The layer 212 is softbaked and exposed to mask 214. After exposure to the mask 214, the layer 212 is developed. In the case of the layer 212 being polyimide, the layer 212 is hardbaked at 400° C. for approximately one hour. Where the layer 212 is resist, it is hardbaked at greater than 300° C. for approximately one hour.

A 0.2 micron multi-layer metal layer 216 is then deposited. Part of this layer 216 forms the passive beam 160 of the actuator 128.

The layer 216 is formed by sputtering 1,000 Å of titanium nitride (TiN) at around 300° C. followed by sputtering 50 Å of tantalum nitride (TaN). A further 1000 Å of TiN is sputtered on followed by 50 Å of TaN and a further 1,000 Å of TiN.

Other materials, which can be used instead of TiN, are $TiB_2$, $MoSi_2$ or (Ti, Al)N.

The layer 216 is then exposed to mask 218, developed and plasma etched down to the layer 212 whereafter resist, applied for the layer 216, is wet stripped taking care not to remove the cured layers 208 or 212.

A third sacrificial layer 220 is applied by spinning on 4 μm of photosensitive polyimide or approximately 2.6 μm high temperature resist. The layer 220 is softbaked whereafter it is exposed to mask 222. The exposed layer is then developed followed by hardbaking. In the case of polyimide, the layer 220 is hardbaked at 400° C. for approximately one hour or at greater than 300° C. where the layer 220 comprises resist.

A second multi-layer metal layer 224 is applied to the layer 220. The constituents of the layer 224 are the same as the layer 216 and are applied in the same manner. It will be appreciated that both layers 216 and 224 are electrically conductive layers.

The layer 224 is exposed to mask 226 and is then developed. The layer 224 is plasma etched down to the polyimide or resist layer 220 whereafter resist applied for the layer 224 is wet stripped taking care not to remove the cured layers 208, 212 or 220. It will be noted that the remaining part of the layer 224 defines the active beam 158 of the actuator 128.

Figure 26E:
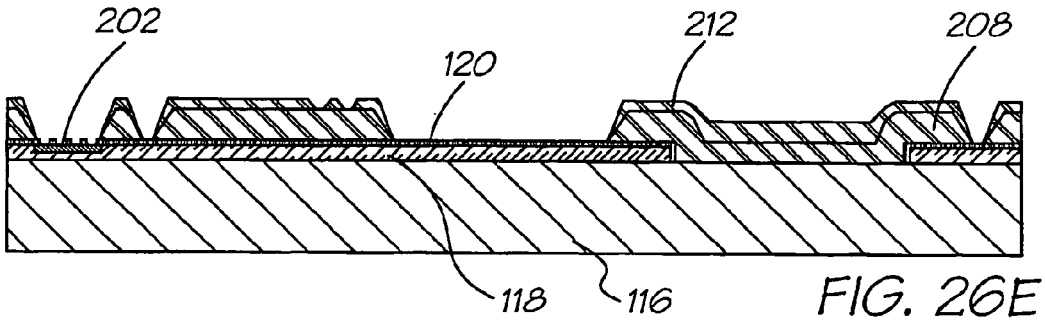
Figure 26F:
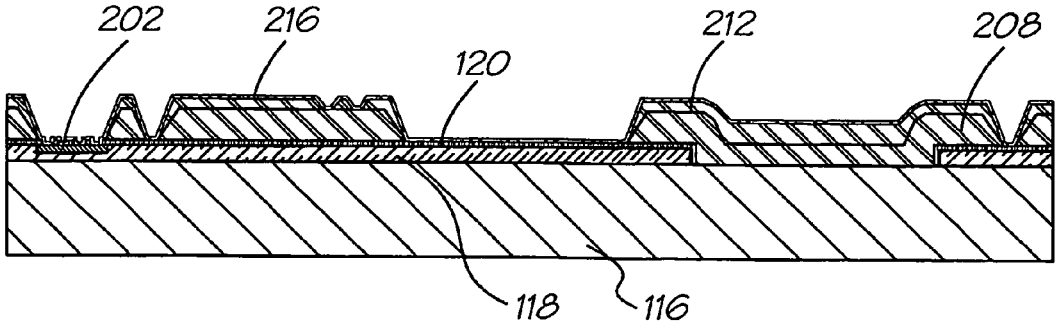
Figure 26G:
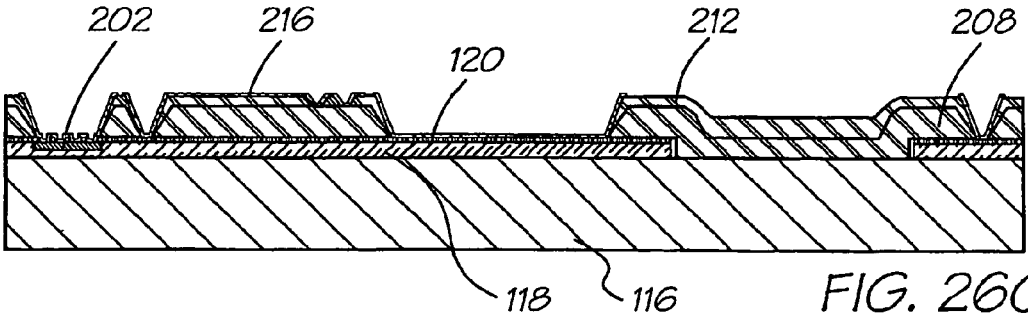
Figure 26H:
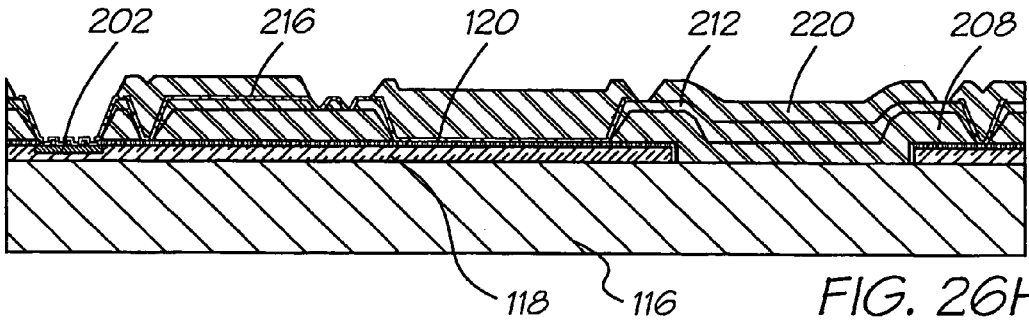
Figure 26I:
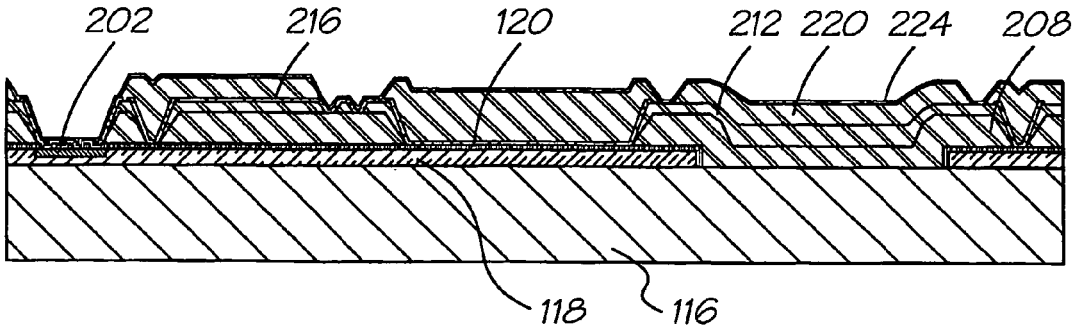
Figure 26J:
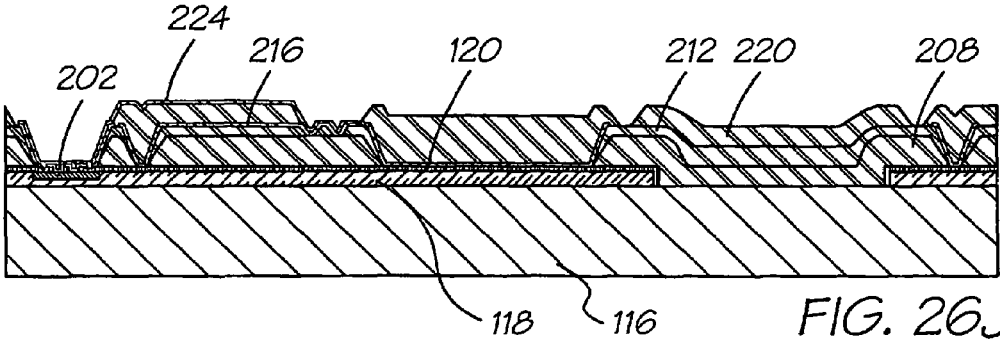
Figure 26K:
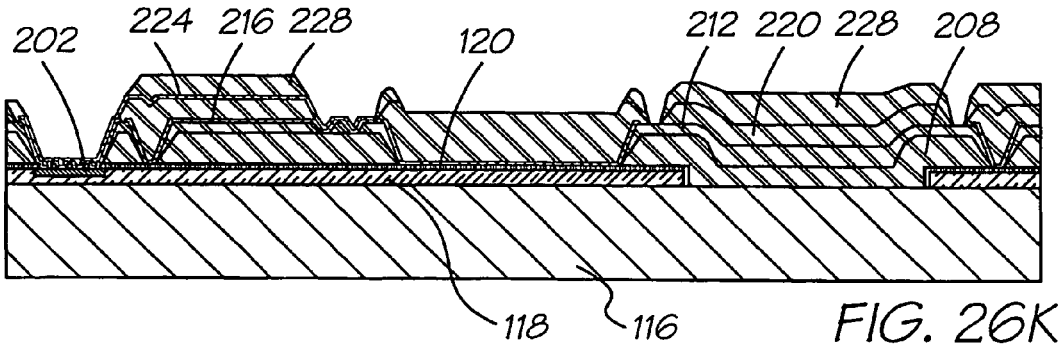
Figure 27I:
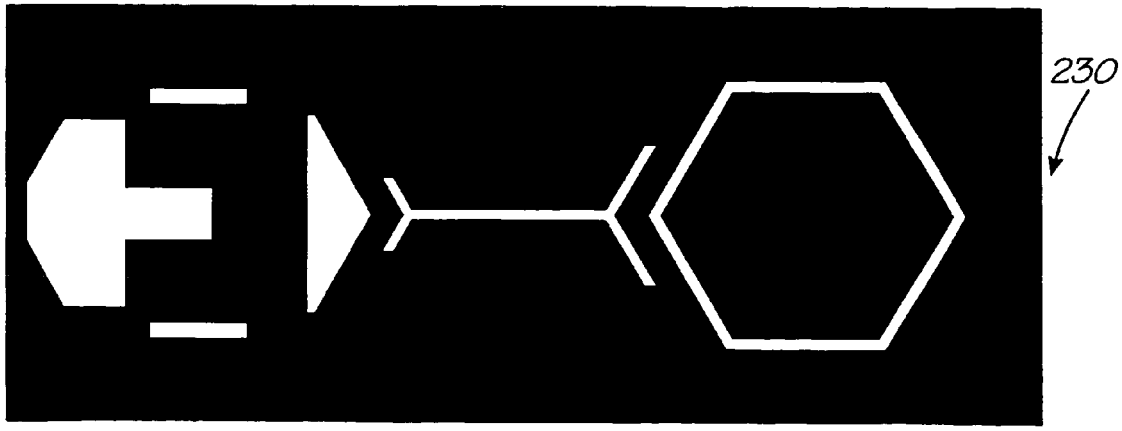

A fourth sacrificial layer 228 is applied by spinning on 4 μm of photosensitive polyimide or approximately 2.6 μm of high temperature resist. The layer 228 is softbaked, exposed to the mask 230 and is then developed to leave the island portions as shown in FIG. 26*k* of the drawings. The remaining portions of the layer 228 are hardbaked at 400° C. for approximately one hour in the case of polyimide or at greater than 300° C. for resist.

Figure 25L:
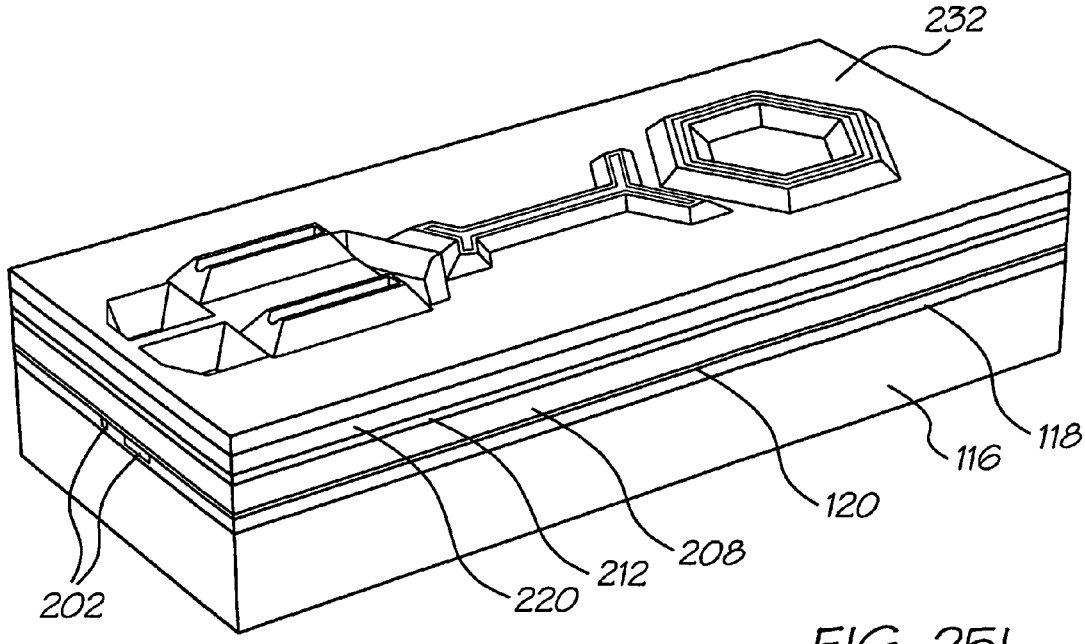
Figure 26L:
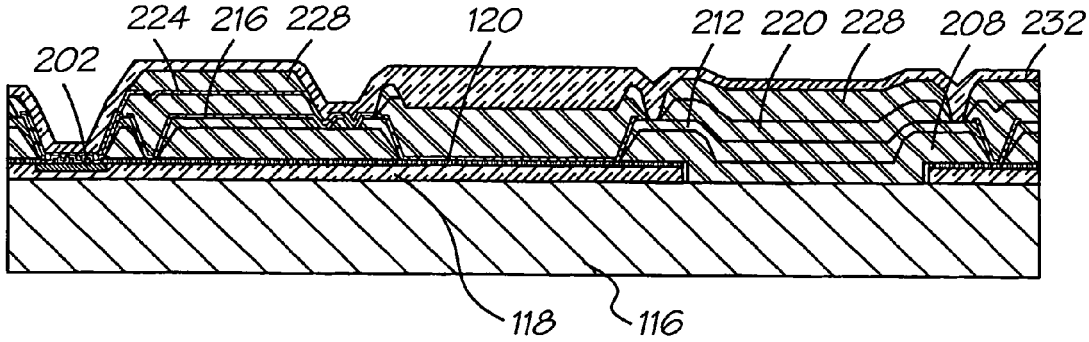
Figure 25M:
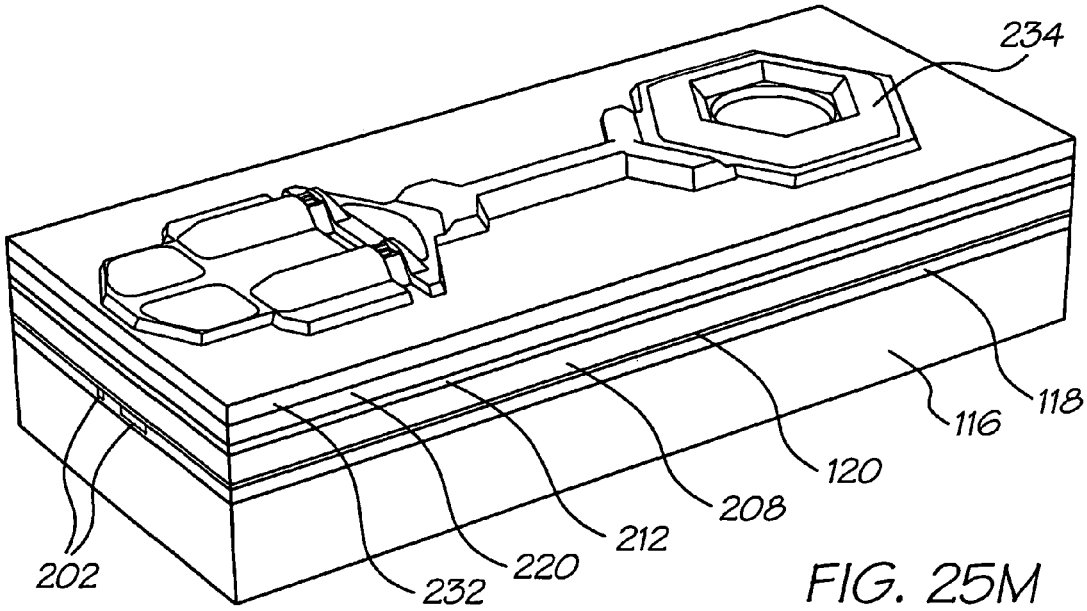
Figure 26M:
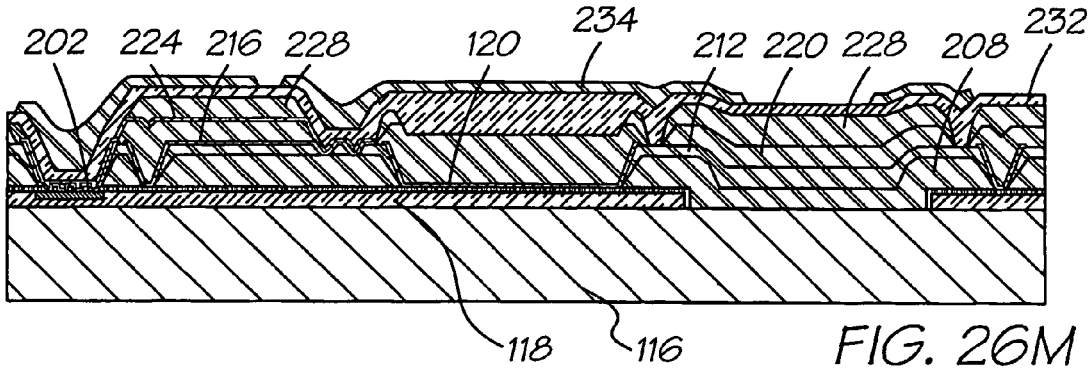
Figure 27J:
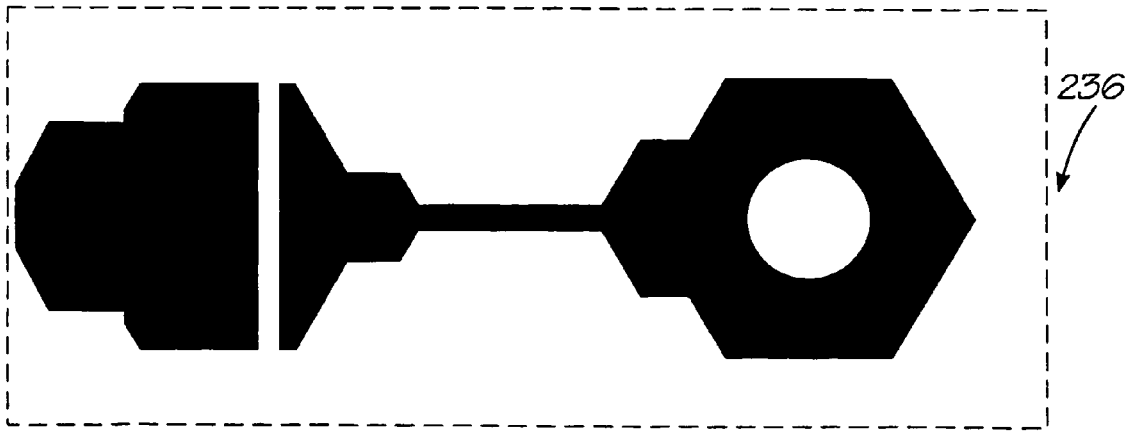
Figure 25N:
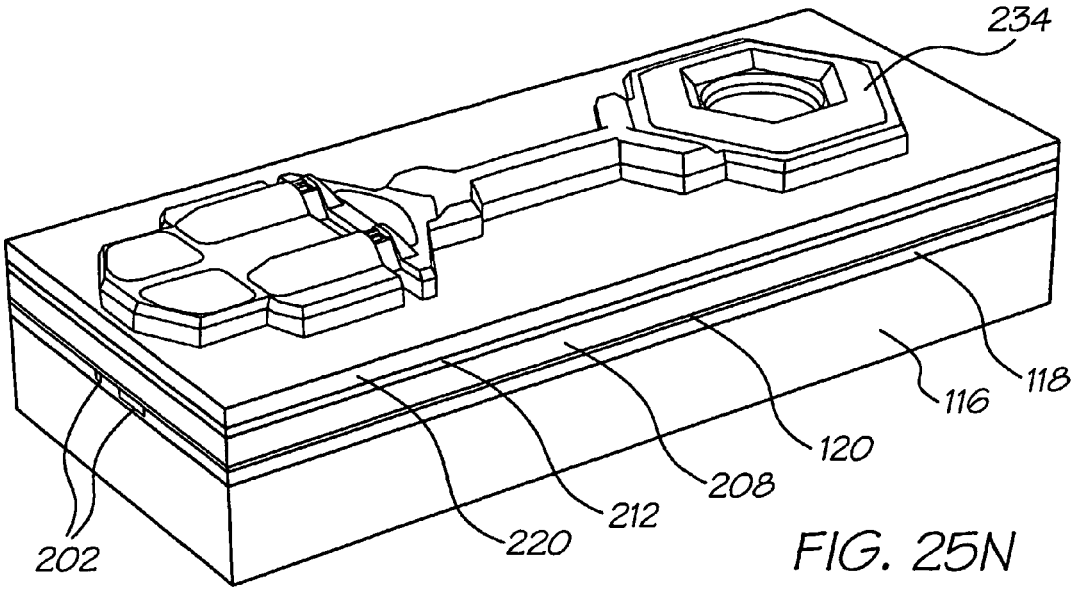
Figure 26N:
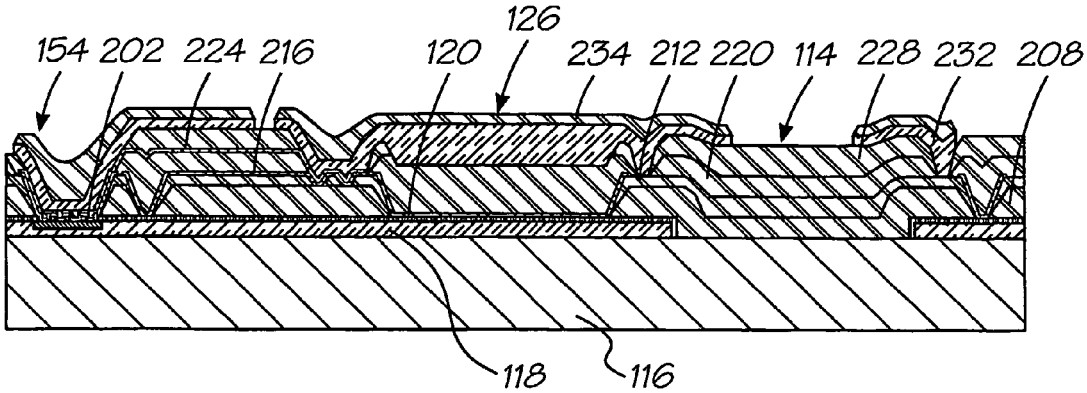
Figure 250:
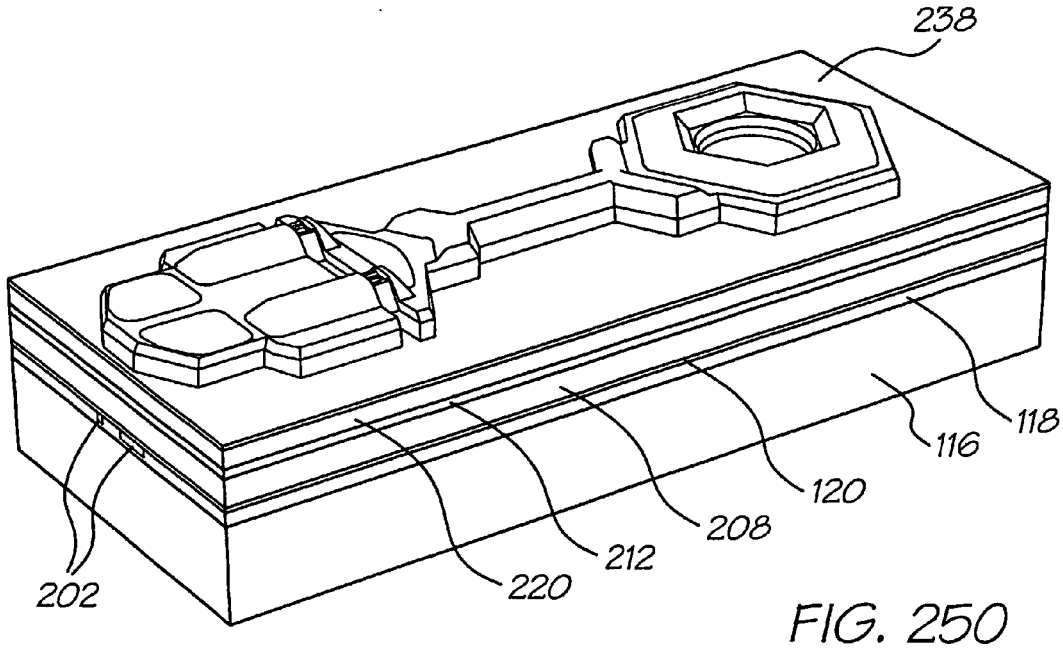
Figure 260:
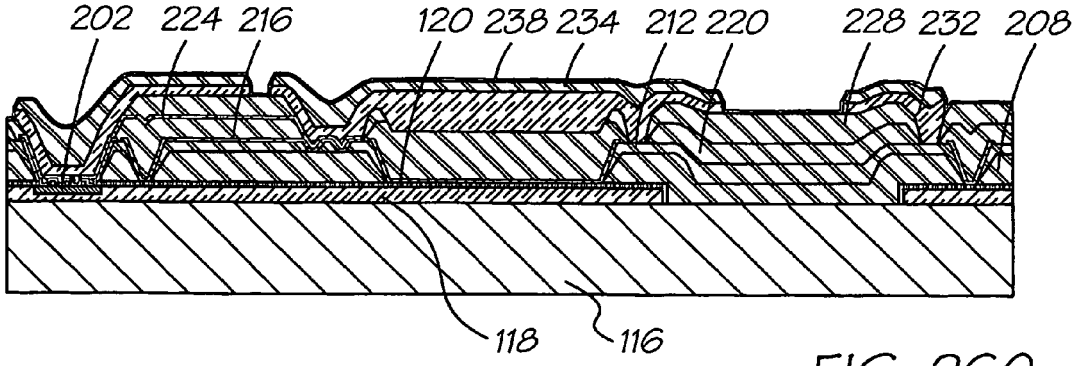

As shown in FIG. 25*l* of the drawing, a high Young's modulus dielectric layer 232 is deposited. The layer 232 is constituted by approximately 1 μm of silicon nitride or aluminum oxide. The layer 232 is deposited at a temperature below the hardbaked temperature of the sacrificial layers 208, 212, 220, 228. The primary characteristics required for this dielectric layer 232 are a high elastic modulus, chemical inertness and good adhesion to TiN.

A fifth sacrificial layer 234 is applied by spinning on 2 μm of photosensitive polyimide or approximately 1.3 μm of high temperature resist. The layer 234 is softbaked, exposed to mask 236 and developed. The remaining portion of the layer 234 is then hardbaked at 400° C. for one hour in the case of the polyimide or at greater than 300° C. for the resist.

The dielectric layer 232 is plasma etched down to the sacrificial layer 228 taking care not to remove any of the sacrificial layer 234.

This step defines the ink ejection port 124, the lever arm 126 and the anchor 154 of the nozzle arrangement 110.

A high Young's modulus dielectric layer 238 is deposited. This layer 238 is formed by depositing 0.2 μm of silicon nitride or aluminum nitride at a temperature below the hardbaked temperature of the sacrificial layers 208, 212, 220 and 228.

Figure 25P:
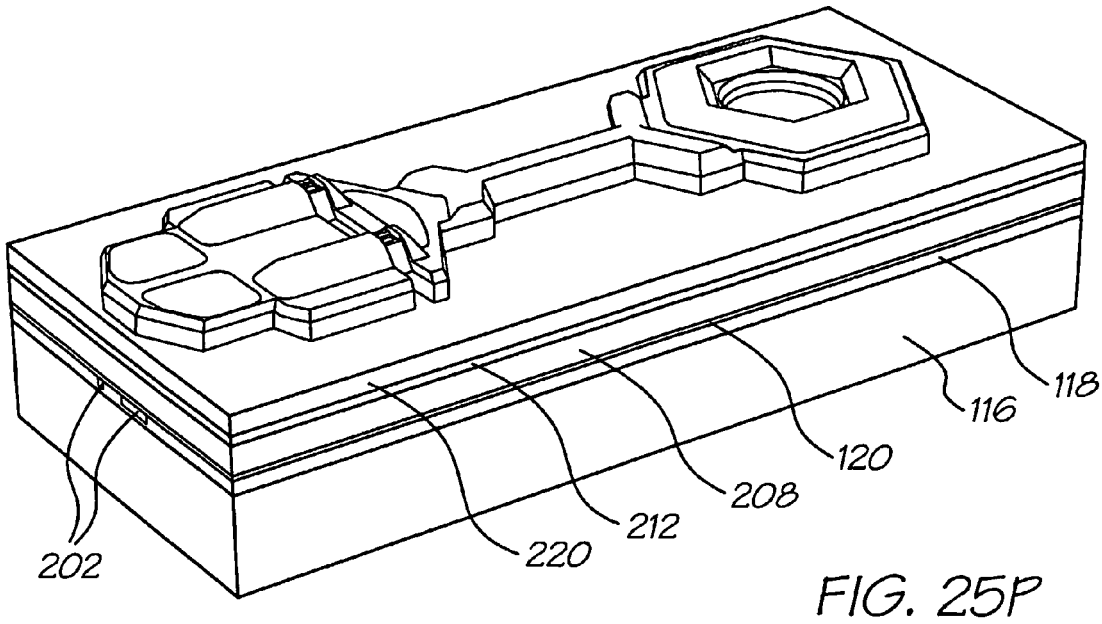
Figure 26P:
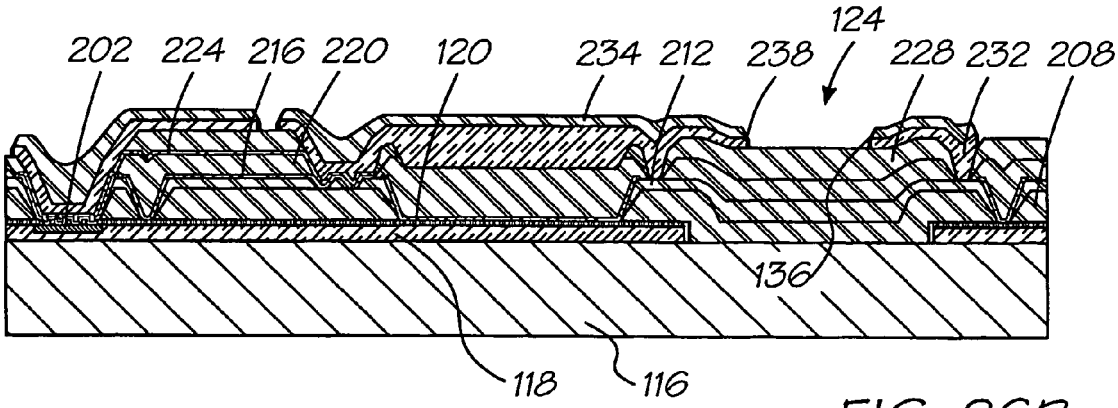
Figure 25Q:
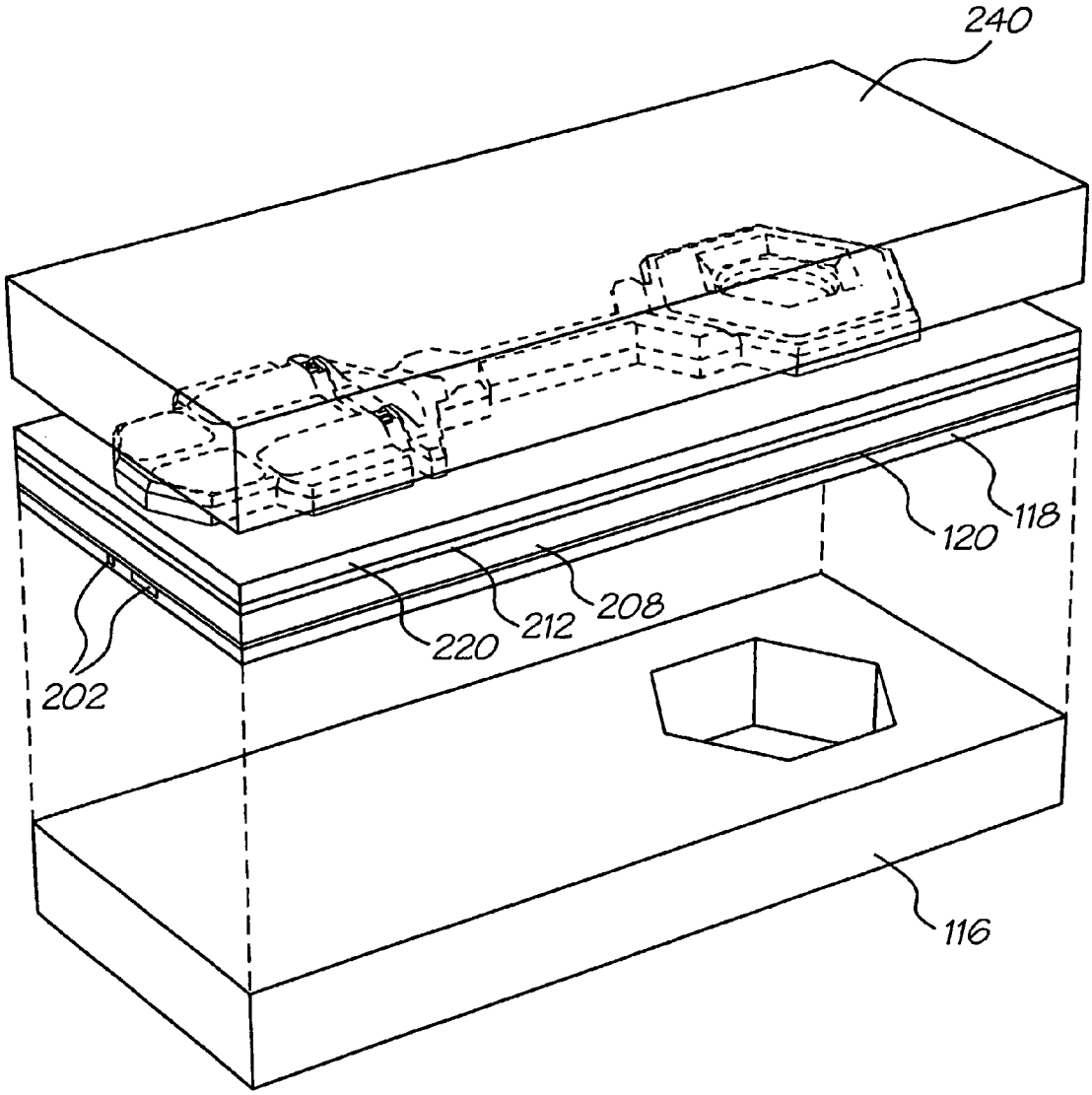

Then, as shown in FIG. 25*p* of the drawings, the layer 238 is anisotropically plasma etched to a depth of 0.35 microns. This etch is intended to clear the dielectric from the entire surface except the sidewalls of the dielectric layer 232 and the sacrificial layer 234. This step creates the nozzle rim 136 around the nozzle opening 124 that "pins" the meniscus of ink, as described above.

An ultraviolet (UV) release tape 240 is applied. 4 μm of resist is spun on to a rear of the silicon wafer 116. The wafer 116 is exposed to mask 242 to back etch the wafer 116 to define the ink inlet channel 148. The resist is then stripped from the wafer 116.

Figure 25R:
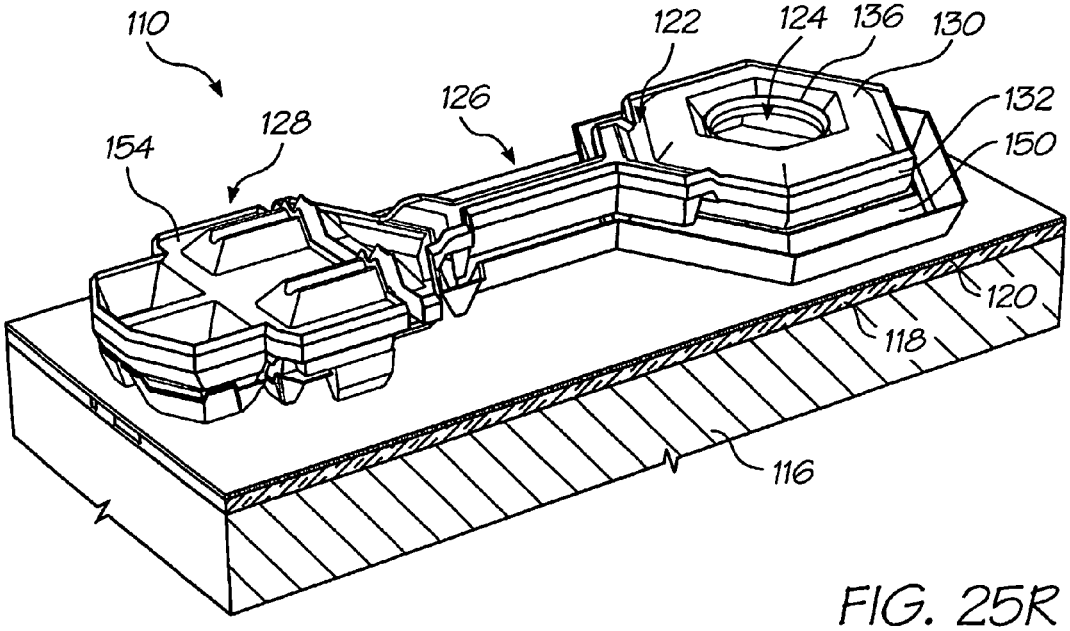
Figure 26R:
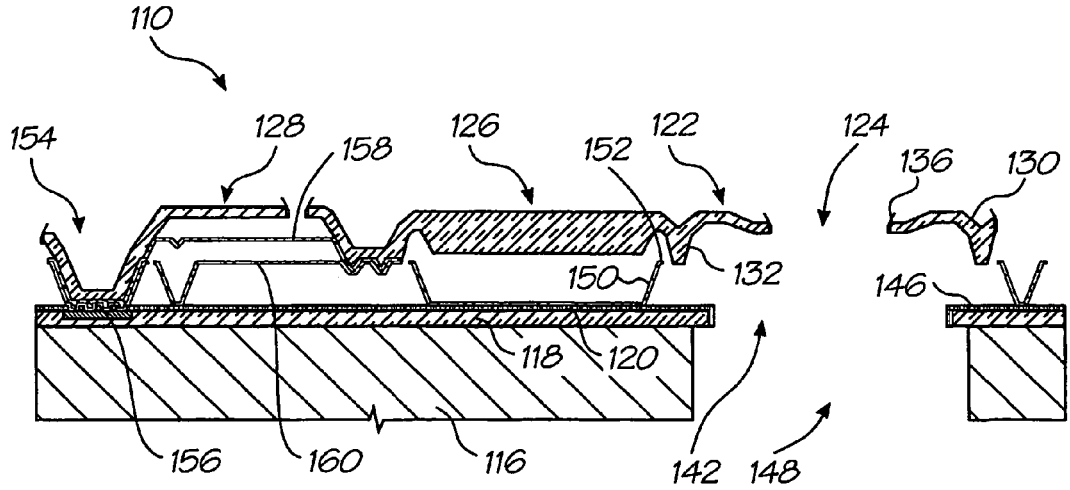
Figure 26Q:
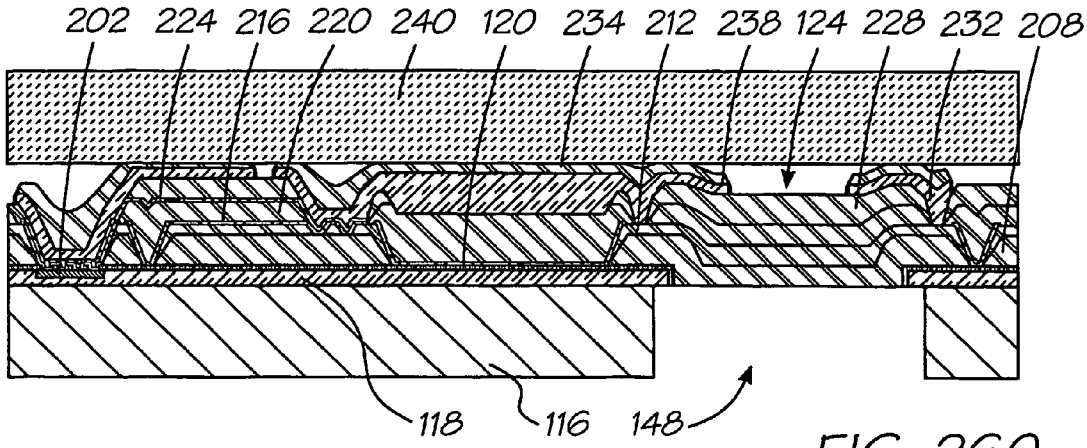
Figure 27K:
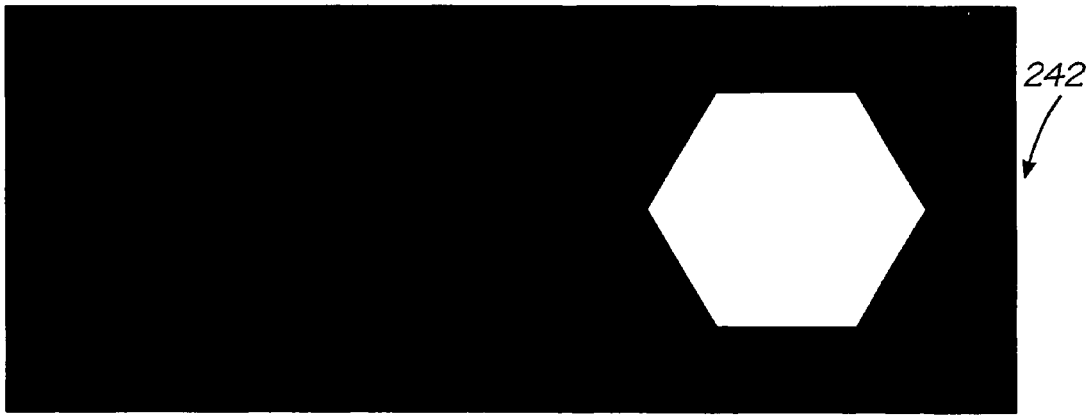
Figure 28A:
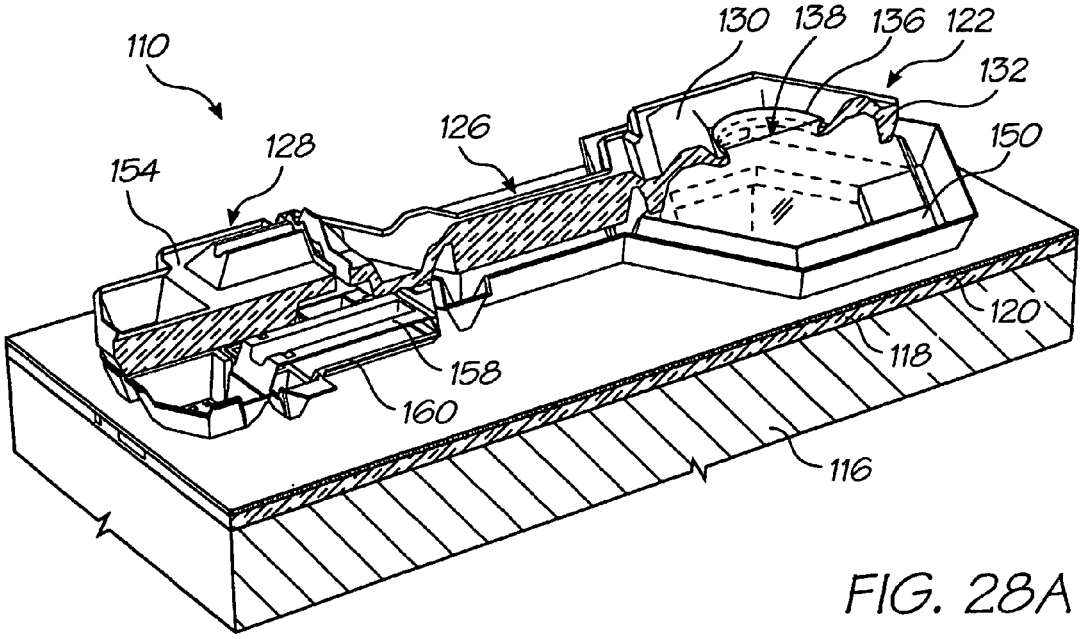
FIGS. 28*a* to 28*c* show three-dimensional views of an operation of the nozzle arrangement manufactured according to the method of FIGS. 25 and 26.
Figure 29A:
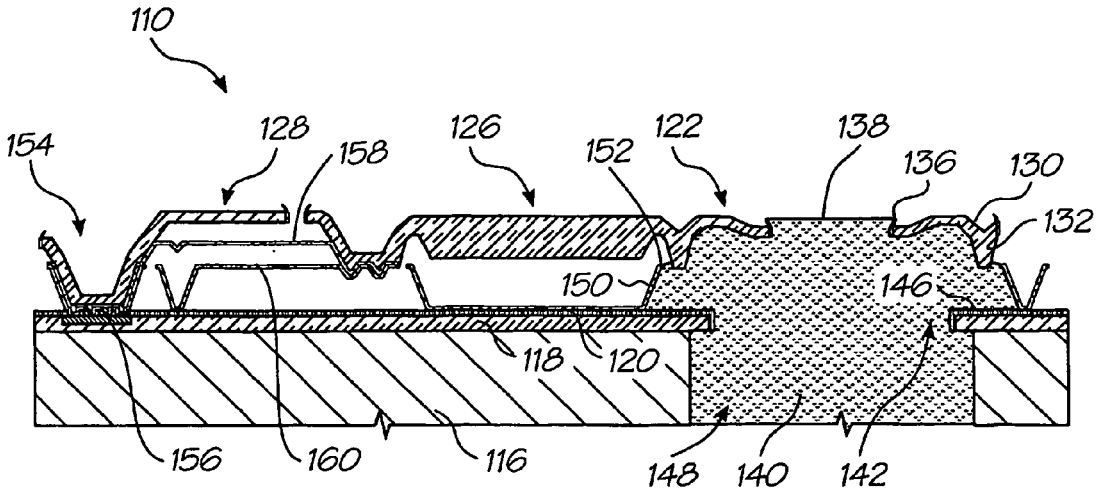
FIGS. 29*a* to 29*c* show sectional side views of an operation of the nozzle arrangement manufactured according to the method of FIGS. 25 and 26.
Figure 28B:
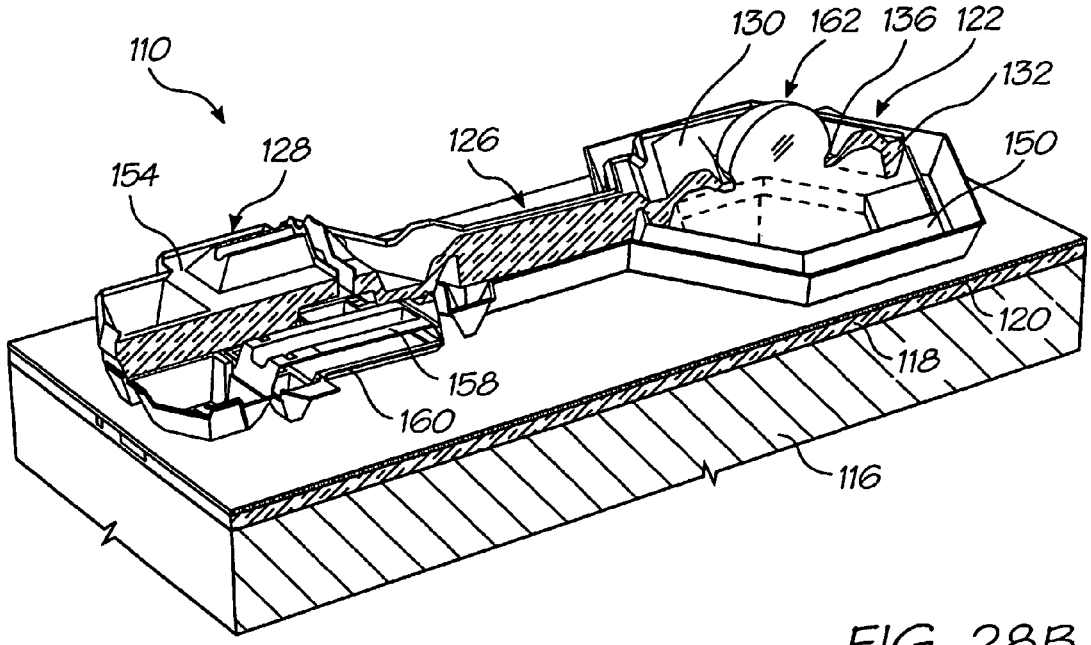
Figure 29B:
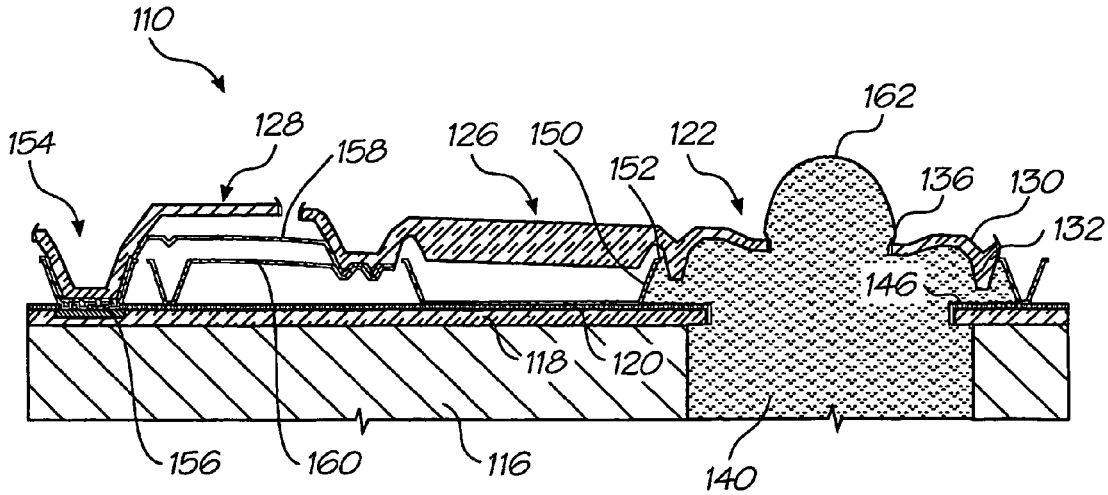
Figure 28C:
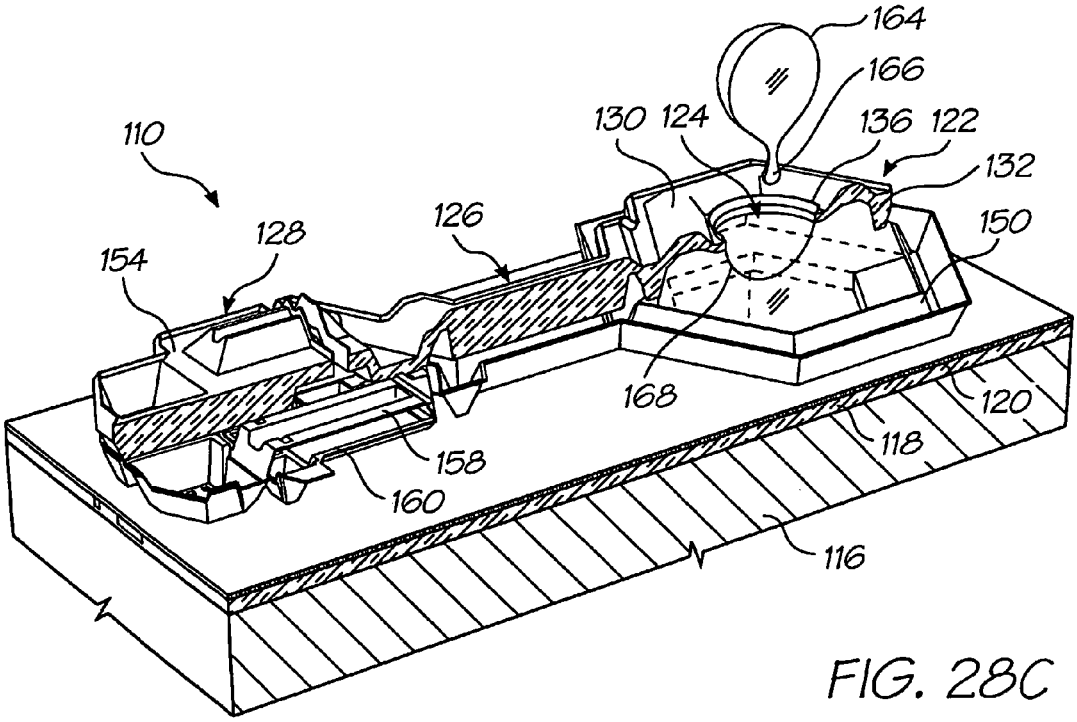
Figure 29C:
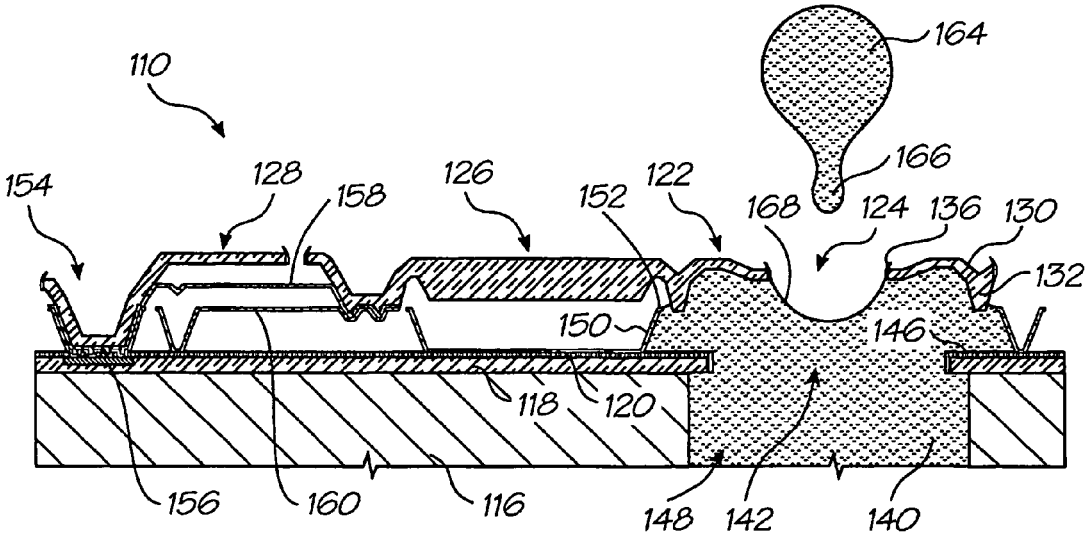

A further UV release tape (not shown) is applied to a rear of the wafer 16 and the tape 240 is removed. The sacrificial layers 208, 212, 220, 228 and 234 are stripped in oxygen plasma to provide the final nozzle arrangement 110 as shown in FIGS. 25*r* and 26*r* of the drawings. For ease of reference, the reference numerals illustrated in these two drawings are the same as those in FIG. 18 of the drawings to indicate the relevant parts of the nozzle arrangement 110. FIGS. 28 and 29 show the operation of the nozzle arrangement 110, manufactured in accordance with the process described above with reference to FIGS. 25 and 26, and these figures correspond to FIGS. 19 to 21 of the drawings.

Figure 30:
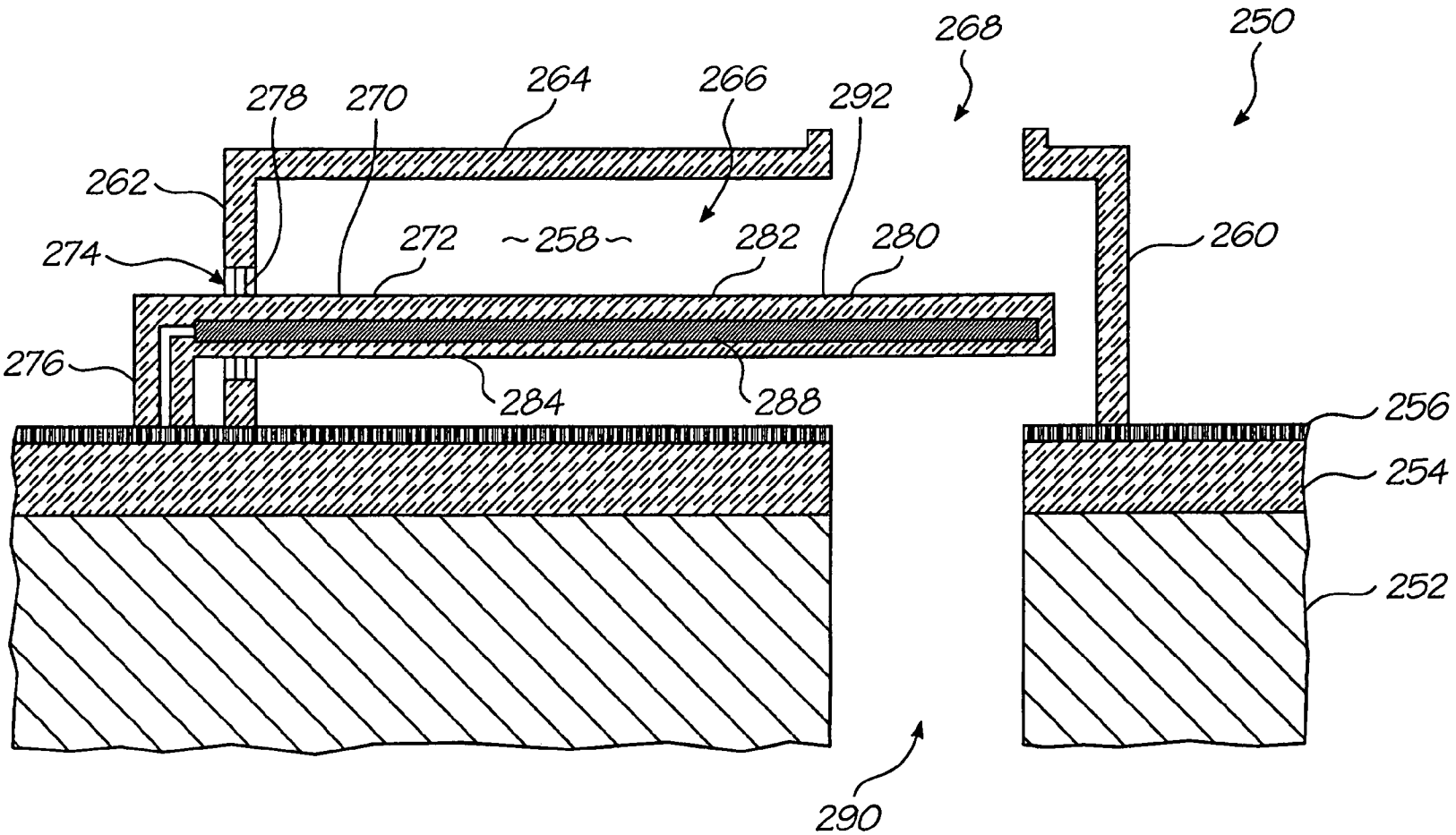
FIG. 30 shows a schematic, conceptual side sectioned view of a nozzle arrangement of a printhead chip of the invention.
Figure 31:
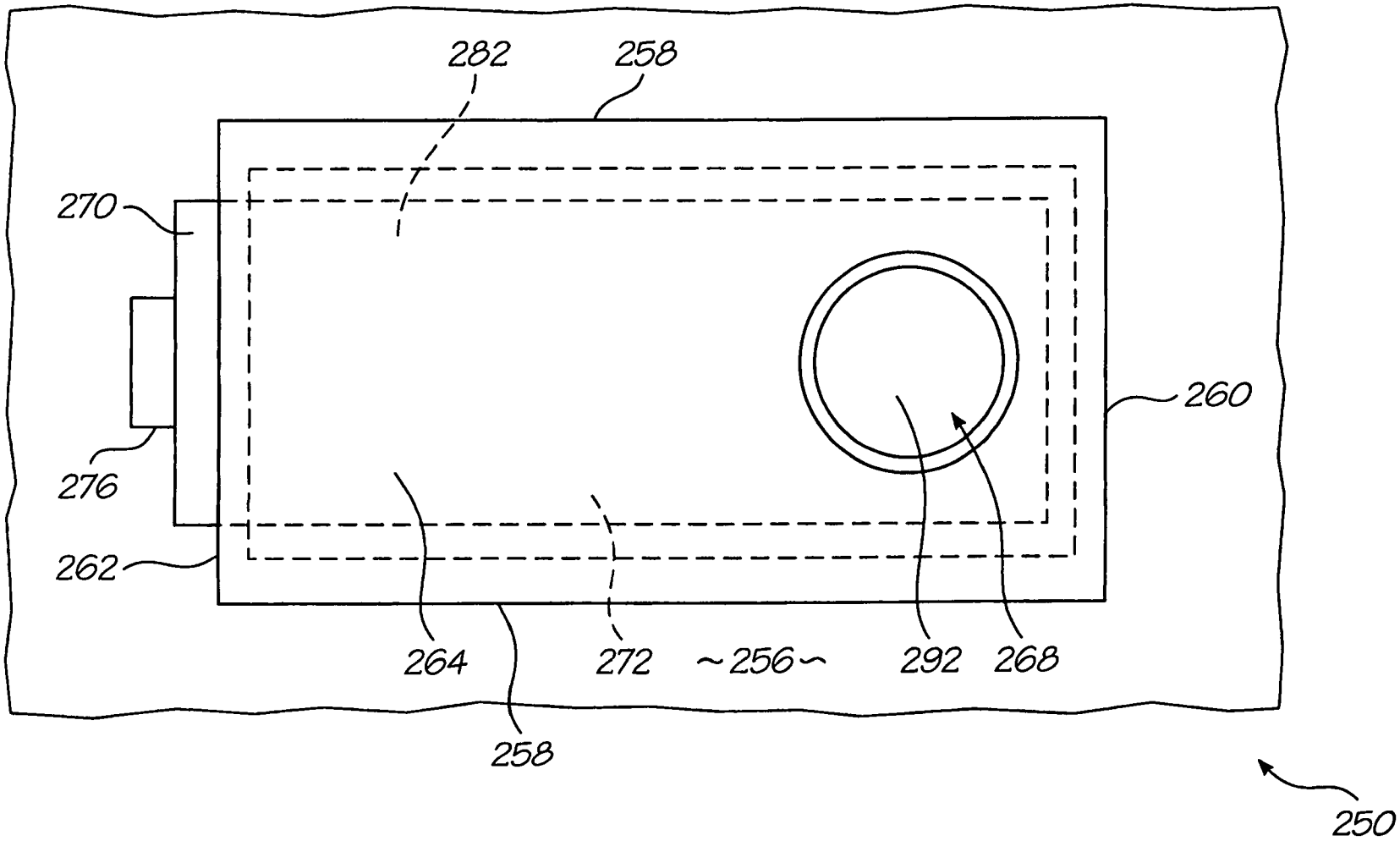
FIG. 31 shows a plan view of the nozzle arrangement of FIG. 30.

In FIGS. 30 and 31, reference numeral 250 generally indicates a nozzle arrangement of a printhead chip of the invention. With reference to the preceding Figs, like reference numerals refer to like parts unless otherwise specified.

The purpose of FIGS. 30 and 31 is to indicate a dimensional relationship that is common to all the nozzle arrangements of the type having a moving member positioned in the nozzle chamber to eject ink from the nozzle chamber. Specific details of such nozzle arrangements are set out in the referenced patents/patent applications. It follows that such details will not be set out in this description.

The nozzle arrangement 250 includes a silicon wafer substrate 252. A drive circuitry layer 254 of silicon dioxide is positioned on the wafer substrate 252. A passivation layer 256 is positioned on the drive circuitry layer 254 to protect the drive circuitry layer 254.

The nozzle arrangement 250 includes nozzle chamber walls in the form of a pair of opposed sidewalls 258, a distal end wall 260 and a proximal end wall 262. A roof 264 spans the walls 258, 260, 262. The roof 264 and walls 258, 260 and 262 define a nozzle chamber 266. An ink ejection port 268 is defined in the roof 264.

An ink inlet channel 290 is defined through the wafer 252, and the layers 254, 256. The ink inlet channel 290 opens into the nozzle chamber 266 at a position that is generally aligned with the ink ejection port 268.

The nozzle arrangement 250 includes a thermal actuator 270. The thermal actuator includes a movable member in the form of an actuator arm 272 that extends into the nozzle chamber 266. The actuator arm 272 is dimensioned to span an area of the nozzle chamber 266 from the proximal end wall 262 to the distal end wall 260. The actuator arm 272 is positioned between the ink inlet channel 290 and the ink ejection port 268. The actuator arm 272 extends through an opening 274 defined in the proximal end wall 262 to be mounted on an anchor formation 276 outside the nozzle chamber 266. A sealing arrangement 278 is positioned in the opening 274 to inhibit the egress of ink from the nozzle chamber 266.

The actuator arm 272 comprises a body 280 of a material with a coefficient of thermal expansion that is high enough so that expansion of the material when heated can be harnessed to perform work. An example of such a material is polytetrafluoroethylene (PTFE). The body 280 defines an upper side 282 and a lower side 284 between the passivation layer 256 and the upper side 282. A heating element 288 is positioned in the body 280 proximate the lower side 284. The heating element 288 defines a heating circuit that is connected to drive circuitry (not shown) in the layer 254 with vias in the anchor formation 276. In use, an electrical signal from the drive circuitry heats the heating element 288. The position of the heating element 288 results in that portion of the body 280 proximate the lower side 284 expanding to a greater extent than a remainder of the body 280. Thus, the actuator arm 272 is deflected towards the roof 264 to eject ink from the ink ejection port 268. On termination of the signal, the body 280 cools and a resulting differential contraction causes the actuator arm 272 to return to a quiescent condition.

It will be appreciated that the upper side 282 of the actuating arm 272 defines a displacement area 292 that acts on the ink to eject the ink from the ink ejection port 268. The displacement area 292 is greater than half the area of the ink ejection port 268 but less than twice the area of the ink ejection port 268. Applicant has found through many thousands of simulations that such relative dimensions provide optimal performance of the nozzle arrangement 250. Such relative dimensions have also been found by the Applicant to make the best use of chip real estate, which is important since chip real estate is very expensive. The dimensions ensure that the nozzle arrangement 250 provides for minimal thermal mass. Thus, the efficiency of nozzle arrangement 250 is optimized and sufficient force for the ejection of a drop of ink is ensured.

The presently disclosed ink jet printing technology is potentially suited to a wide range of printing system including: color and monochrome office printers, short run digital printers, high speed digital printers, offset press supplemental printers, low cost scanning printers high speed pagewidth printers, notebook computers with inbuilt pagewidth printers, portable color and monochrome printers, color and monochrome copiers, color and monochrome facsimile machines, combined printer, facsimile and copying machines, label printers, large format plotters, photograph copiers, printers for digital photographic "minilabs", video printers, PHOTO CD (PHOTO CD is a registered trade mark of the Eastman Kodak Company) printers, portable printers for PDAs, wallpaper printers, indoor sign printers, billboard printers, fabric printers, camera printers and fault tolerant commercial printer arrays.

It would be appreciated by a person skilled in the art that numerous variations and/or modifications may be made to the present invention as shown in the specific embodiments without departing from the spirit or scope of the invention as broadly described. The present embodiments are, therefore, to be considered in all respects to be illustrative and not restrictive.

I claim:

1. An inkjet printhead chip that comprises a wafer substrate, drive circuitry positioned on the wafer substrate, and a plurality of nozzle arrangements positioned on the wafer substrate, each nozzle arrangement comprising nozzle chamber walls and a roof wall positioned on the wafer substrate to define a nozzle chamber and an ink ejection port in the roof wall, a micro-electromechanical actuator that is connected to the drive circuitry, the actuator including a movable member that is displaceable on receipt of a signal from the drive circuitry, the movable member defining a displacement surface that acts on ink in the nozzle chamber to eject the ink from the ink ejection port, wherein the movable member of each actuator defines at least part of the nozzle chamber walls and roof wall so that movement of the movable member serves to reduce a volume of the nozzle chamber to eject the ink from the ink ejection port.

2. An ink jet printhead chip as claimed in claim 1 wherein the area of the displacement surface is between two and ten times the area of the ink ejection port.

3. An inkjet printhead chip as claimed in claim 1, in which the movable member of each actuator defines the roof wall.

4. An inkjet printhead chip as claimed in claim 1, in which each actuator is thermal in the sense that it includes a heating circuit that is connected to the drive circuitry, the actuator being configured so that, upon heating, the actuator deflects with respect to the wafer substrate as a result of differential expansion, the deflection causing the necessary movement of the movable member to eject ink from the ink ejection port.

5. An inkjet printhead that includes a plurality of inkjet printhead chips as claimed in claim 1.

* * * * *